US006439986B1

(12) United States Patent
Myoung et al.

(10) Patent No.: US 6,439,986 B1
(45) Date of Patent: Aug. 27, 2002

(54) CONDITIONER FOR POLISHING PAD AND METHOD FOR MANUFACTURING THE SAME

(75) Inventors: Bum Young Myoung, Inchun; Su Nam Yu, Daejun, both of (KR)

(73) Assignee: Hunatech Co., Ltd. (KR)

( * ) Notice: Subject to any disclaimer, the term of this patent is extended or adjusted under 35 U.S.C. 154(b) by 0 days.

(21) Appl. No.: 09/521,035

(22) Filed: Mar. 8, 2000

(51) Int. Cl.[7] ..... B24B 21/18
(52) U.S. Cl. ..... 451/443; 451/548
(58) Field of Search ..... 451/443, 444, 451/56, 72, 548; 438/691, 692; 156/345

(56) References Cited

U.S. PATENT DOCUMENTS

| | | | | |
|---|---|---|---|---|
| 5,152,917 A | | 10/1992 | Pieper et al. | |
| 5,489,233 A | | 2/1996 | Cook et al. | |
| 5,536,202 A | | 7/1996 | Appel et al. | |
| 5,989,405 A | * | 11/1999 | Murata et al. | 205/110 |
| 6,001,008 A | * | 12/1999 | Fujimori et al. | 451/443 |
| 6,027,659 A | * | 2/2000 | Billett | 216/11 |

FOREIGN PATENT DOCUMENTS

| | | |
|---|---|---|
| JP | 7328937 | 12/1995 |
| JP | 11010530 | 1/1999 |
| JP | 1133911 | 9/1999 |
| JP | 11300601 | 11/1999 |

* cited by examiner

*Primary Examiner*—Timothy V. Eley
*Assistant Examiner*—Dung Van Nguyen
(74) *Attorney, Agent, or Firm*—Ostrolenk, Faber, Gerb & Soffen, LLP

(57) ABSTRACT

A conditioner for polishing pad and a method for manufacturing the same are disclosed. The conditioner includes a substrate having formed with a plurality of geometrical protrusions of an uniformed height on at least one of its sides, and a cutting portion having a diamond layer or an uniformed thickness formed substantially on a whole surface of the side of the substrate having the geometrical protrusions. The geometrical protrusions have a flat upper surface or the upper surface may comprise a plurality of smaller geometrical protrusions formed by recessed grooves. The substrate is made from ceramic or cemented carbide materials and have a shape of a disk, a plate having multiple corner, a cup, a segment, or a doughnut with flattened upper and lower surfaces. The conditioner may further include a body portion being fixedly attached to the substrate at a side opposite to the side having formed with geometrical protrusions for linking the cutting portion to conditioning equipment. The cutting portion of the conditioner realized by having above shapes and structures makes line and surface contacts with polishing pad surface. The diamond layer coated on the cutting surface strengthens the structural integrity of the cutting surface to increase the cutting performance and imparts anti-wear and anti-corrosive properties to render the conditioner with a prolonged lifetime usage.

27 Claims, 21 Drawing Sheets

CONDITIONER FOR POLISHING PAD AND METHOD FOR MANUFACTURING THE SAME

BACKGROUND OF THE INVENTION

1. Field of the Invention

The present invention relates to a conditioner for polishing pad and a method for manufacturing the same, and more particularly to a conditioner for polishing pad to be used in chemical mechanical polishing (CMP) process and a method for manufacturing the same.

2. Description of the Prior Art

Generally, chemical mechanical polishing is widely used in the manufacturing process of semiconductor devices to obtain smooth and even surfaced wafers. Typically, a wafer to be polished is held by a carrier positioned on a polishing pad attached above a rotating platen (not shown), then by applying slurry to the pad and pressure to the carrier, the wafer is polished by relative movements of the platen and the carrier. A conventional polishing pad used for chemical mechanical polishing process generally comprises a multitude of fine holes having a diameter size of 30–70 $\mu$m for exhibiting pumping-effect when pressure is applied to the polishing pad to achieve a high removal rate. However, after a prolonged use, the holes wear out and become deposited with polishing residues, causing an uneven surface of the polishing pad. As a result, its ability to polish wafers decreases in time and the effectiveness of CMP process of achieving an uniformly even wafer surface becomes diminished.

To recover the polishing performance and to compensate for the uneven surface of the polishing pad, conditioning process utilizing a conditioner for removing the uneven surface of the polishing pads is commonly implemented by CMP protest.

FIGS. 1A to 1C show a structure of a diamond conditioner used for conditioning polishing pads, which is manufactured by conventional electro-deposition method. Such diamond conditioner is typically made from an electro-plated diamond disk in which diamond particles 16 are scattered onto a stainless steel body portion 10 and electro-deposited by bonding metal 18 such as nickel or made from a brazed diamond disk in which the diamond particles 16 are fixed onto the body portion 10 by melting the bonding metal 18.

However, the conditioners made from such electro-deposition and braze methods have cutting surfaces of an uneven height caused by irregular distribution and varying sizes of the diamond particles 16 as illustrated by a cutting portion 12 in FIG. 1C. Particularly, having diamond particles with diameter size beyond the range of 150–250 $\mu$m in the conditioner cutting surface causes an undesirable surface roughness.

Further, because the conditioners having the above structure polishes wafers by making partial point contact and due to obtuse cutting angles of diamond particles, the cutting efficiency obtained by such conditioners is low. As such, in order to improve the cutting efficiency, it is necessary to apply high pressure in the conventional conditioning processes. In conventional polishing pads having a dual-pad structure commonly made from polyurethane material, CMP is carried out in top pad while bottom pad provides pressure required for the conditioning process. When high pressure is applied to the top pad by conditioner during the conditioning process, due to the compressibility of the bottom pad, the conditioning cannot be smoothly carried out. Thus, maintaining a flat and leveled polishing pad surface becomes a difficult task.

More, the conditioners made from electro-deposition and brazed methods does not provides grooves or ditches for draining particles from the polishing pads. As a result, residual particles deposit and accumulate on the conditioner surface, which further attributes to decreasing the conditioning effectiveness.

Conventionally, the conditioning process can be carried out simultaneously with CMP process. Such in-situ conditioning process are classified into oxide or metal CMP processes by the type of slurry used for the polishing process, which is typically constituted by silica, alumina or ceria polishing materials. The slurry used for oxide CMP generally has a pH value with 10–12, while the slurry used for metal CMP has a pH value less than 4, and the bonding metal 18 used for fixing the diamond particles 16 onto the cutting surface of the conditioner is nickel, chromium or the like metals. In implementing either oxide or metal CMP in-situ conditioning process, because the polishing process is simultaneously carried out with conditioning process, the bonding metal 18 holding the diamond particles 16 is also affected by slurry, resulting in frequent detachments of the diamond particles 16 from the conditioner surface. Further, in metal CMP in-situ conditioning process, the strong acid property of the slurry used for the process has a tendency to corrode the bonding metal 18 to weaken its bonding effect, which ultimately causes the detachments of the diamond particles 16.

The detached diamond particles 18 usually attach to the surface of the polishing pads and impart fatal scratches to the wafer surface during the polishing process to cause high defective rates in the semiconductor manufacturing process. Consequently, the polishing pads must be frequently replaced.

Further, metal ions from the eroded bonding metal 18 in metal CMP in-situ conditioning process often attaches to metal lines of the wafer circuits to causes short-circuits. In addition, metal ions from the in-situ conditioning process substantially attributes to the metal ion contamination of the wafers, and because the resulting semiconductor defects caused by the contamination are detected at the later manufacturing stages, its impact in the loss incurred from the defects is considerable in the industry.

SUMMARY OF THE INVENTION

In view of the foregoing, it is an object of the present invention to provide a conditioner for polishing pad which has an excellent and uniform degree of surface roughness for preventing defects caused from the detachments of diamond particles and metal ion contamination and for effectively conditioning the polishing pads in absence of high pressure in chemical mechanically-polishing process for the semiconductor wafers.

It is a second object of the present invention to provide a method for manufacturing a conditioner for polishing pad which has the characteristics and functions of the above described conditioner.

According to the present invention, there is provided a conditioner for polishing pad comprises a substrate having integrally formed with a plurality of geometrical protrusions in an uniformed height on at least one side of the substrate and a diamond layer of an uniformed thickness formed substantially on a whole surface of the substrate side having geometrical protrusions.

It is preferred that the above geometrical protrusions have rectangular or cylindrical shapes and have flat and even upper surfaces. Optionally, the upper surfaces of the geometrical protrusions can have a plurality of smaller geometrical protrusions formed by a pair of diagonally-crossed grooves having U or V cross-sectional shapes or by a number of crossed-strips of grooves having U or V cross-sectional shapes. The smaller geometrical protrusions formed on the upper surfaces of the geometrical protrusions have a plane view shape of triangle, rectangle or rectangular pyramid.

The plurality of geometrical protrusions integrally formed on the surface of the substrate has a crossed-strip pattern realized by crossing-strips of ditches having U or V cross-sectional shapes, where the U or V cross-sectional shapes are defined by a side portion of the geometrical protrusions and a bottom portion of the ditches. The crossing-strips of ditches all have same width and or depth, or alternatively a ditch having a greater width and or depth can be formed at an interval of a certain number of ditches on the crossed-strip pattern as a region dividing ditch.

The substrate is not limited by any shapes as long as a plurality of geometrical protrusions can be realized on its surface. For example, the substrate can have a shape of a disk, a doughnut or a plate having multiple corners, or on one side of substrate an outer ring portion can be formed raised above a middle portion to obtain a substrate having a cross sectional profile of a cup. Alternatively, the doughnut shape substrate can have an outer belt portion having formed with a number of segmented portions separated by valleys radially expanding from a center of the substrate on which a plurality of geometrical protrusions can be formed.

The diamond layer is thinly and evenly deposited on the substrate surface by chemical vapor deposition (CVD) method.

It is preferred that the substrate is made from ceramic or cemented carbide materials.

The conditioner of the present invention further comprises a body portion formed at a side opposite to the side having formed with geometrical protrusions, which functions to link the conditioner with conditioning equipments. It is preferred that the body portion is made from stainless steel, engineering plastic or ceramic.

In another preferred aspect of the present invention, the conditioner has a segmented shape, in which the body portion has a cross-sectional shape of a doughnut with flattened upper and lower surfaces or a cross-sectional shape of a cup. The conditioner also comprises a number of independent segmented cutting portions separated by a certain distance and fixedly attached to one of surfaces of the body portion to take on a shape of a belt, where the independent segmented cutting portions are realized on their respective substrates made from ceramic or cemented carbide materials. Further, a diamond layer having an uniform thickness is substantially formed on the whole surface of the substrate.

The conditioner of the present invention having a structure of various-types of shape is manufactured by a method comprising the steps of a) forming crossed strips of ditches on a substrate having a certain shape to form a plurality of geometrical protrusions in an uniformed height on a surface of the substrate by utilizing a strong cutting wheel such as diamond wheel, and b) forming a diamond layer of an uniformed thickness coated substantially on a whole surface of the substrate processed by step a) by chemical vapor deposition (CVD).

Prior to implementing step b), the method can optionally comprise the step of forming a certain number of grooves in predetermined crossing directions to form a plurality of smaller geometrical protrusions in an uniform height on the surfaces of the geometrical protrusions by grind and or cutting process.

The substrate to be formed with ditches can have a plurality of shapes as already described earlier and the geometrical protrusions are realized by recessed depressions of ditches formed by grind and or cutting processes. The ditches formed in a layout of crossed-strips renders the resulting geometrical protrusions to have a pattern of crossed-strips on the substrate surface.

Prior to implementing step a), it is preferred that the method further comprises the steps of subjecting the substrate to fine grinding and lapping processes to obtain an uniform surface on at least one side of the substrate and to obtain substantially parallel substrates surfaces.

Alternatively, the step of forming geometrical protrusions on the substrate surface as outlined in step a) can be implemented by molding process in which a predetermined molding composition is injected and cooled in a mold having the shape of a substrate with geometrical protrusions.

The method may further comprises the step of attaching a body portion to the substrate at a side opposite to the side having formed with geometrical protrusions for linking the conditioner to conditioning device.

It is preferred that the substrate is made from ceramic or cemented carbide materials and the portion is made from stainless steel, engineering plastic, ceramic or the like material.

BRIEF DESCRIPTION OF THE DRAWINGS

The above objects and other advantages of the present invention will become more apparent by describing in detail embodiments thereof with reference to the attached drawings in which:

FIGS. 1A to 1C show a conventional conditioner for polishing pad, wherein FIG. 1A is a plane-view. FIG. 1B is a cross-sectional view taken from line 1B—1B of FIG. 1A, and FIG. 1C is an enlarged cross-sectional view showing a portion of the conventional conditioner:

FIGS. 2A to 2D show a conditioner for polishing pad manufactured from a substrate having a disk shape according to a first preferred embodiment of the present invention, wherein FIG. 1A is a plane-view, FIG. 2B is a cross-sectional view taken from line 2B—2B of FIG. 2A, and FIGS. 2C and 2D are respective enlarged plane and cross-sectional views showing body and cutting portions of the conditioner;

FIGS. 3A and 3B show a conditioner manufactured from a substrate having a doughnut shape according to the present invention, wherein FIG. 3A is a plane-view and FIG. 3B is a cross sectional view taken from line 3B—3B of FIG. 3A;

FIGS. 4A and 4B show a conditioner manufactured from a doughnut shape substrate having a number of segmented portions separated by valleys on one of its surfaces according to even yet another preferred embodiment of the present invention, wherein FIG. 4A is a plane-view and FIG. 4B is a cross-sectional view taken from line 4B—4B of FIG. 4A;

FIGS. 5A and 5B show a conditioner having a cup shape manufactured by attaching a body portion to a doughnut shape substrate according to even yet another preferred embodiment of the present invention, wherein FIG. 5A is a plane-view and FIG. 5B is a cross-sectional view taken from line 5B—5B of FIG. 5A;

FIGS. 6A and 6B show a conditioner manufactured by forming a segmented cutting portion having a shape of a belt on a surface of a doughnut shape substrate according to even yet another preferred embodiment of the present invention, wherein FIG. 6A is a plane-view and FIG. 6B is a cross-sectional view taken from line 6B—6B of FIG. 6A;

DETAILED DESCRIPTION OF THE PREFERRED EMBODIMENTS

The preferred embodiment of the present invention will be described in detail below. The following embodiment is provided to further illustrate the invention and are not intended to limit the scope of the present invention.

First, a conditioner of the present invention can be realized with a structure selected from a range of diverse shapes and arrangements, and the preferred embodiments of a conditioner having various structural shapes manufactured according to the present invention and will now be described in detail below.

Figure 2A:
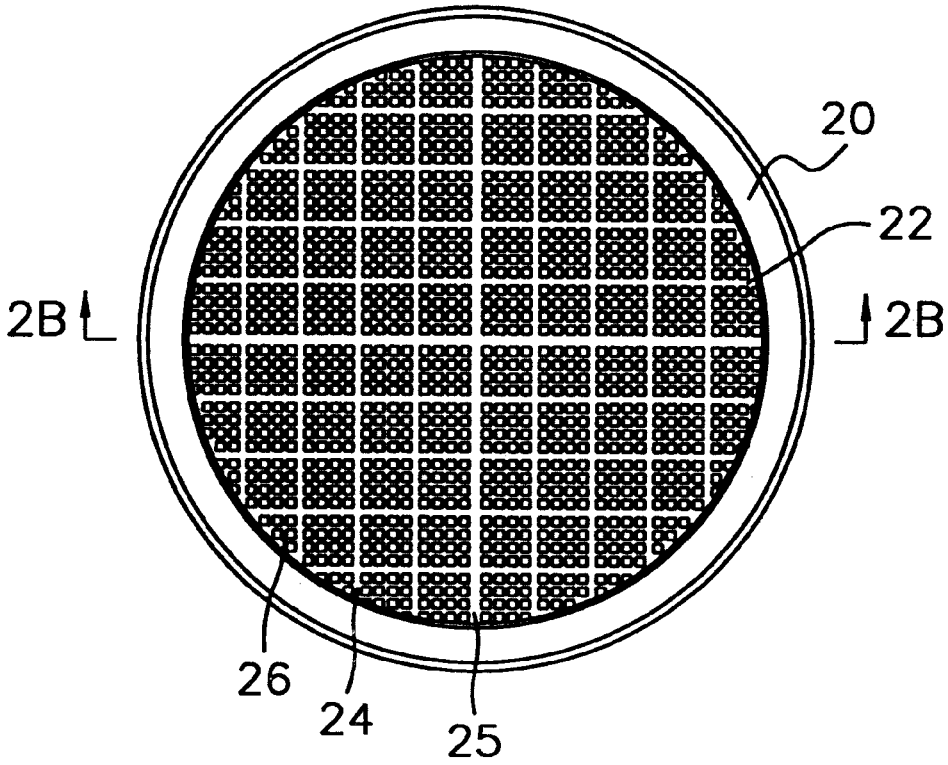
Figure 2B:
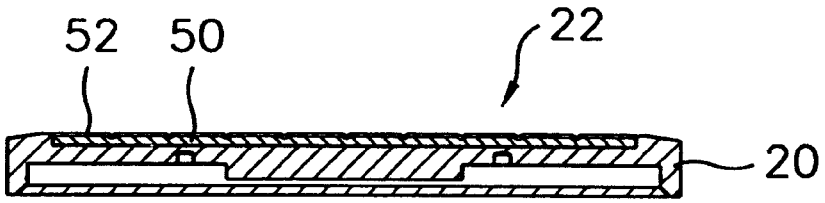
Figure 2C:
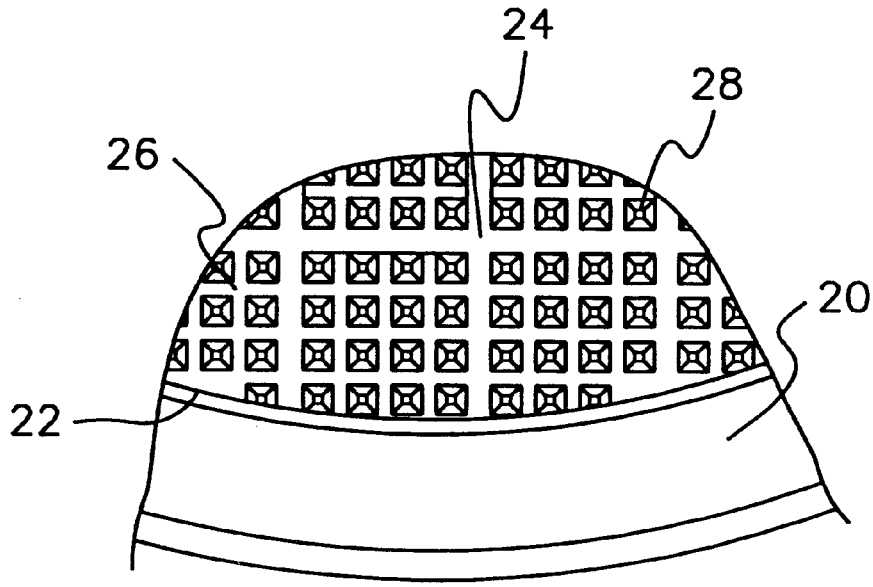
Figure 2D:
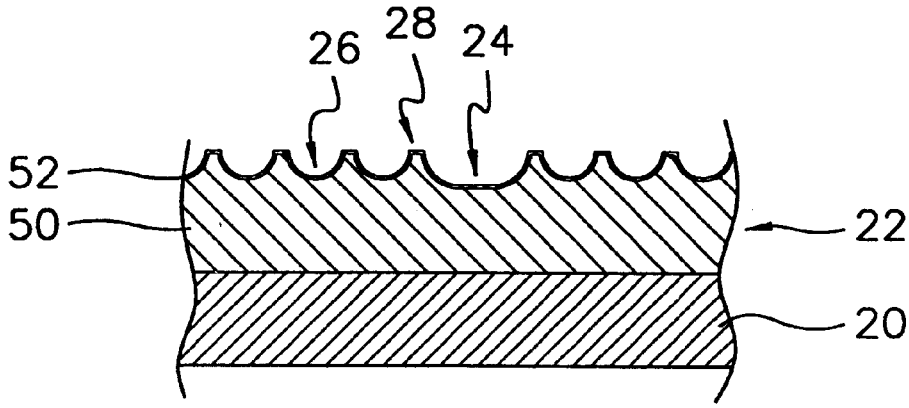

Referring to FIG. 2A, a body portion 20 is made from a material having anti-corrosive and chemically stable properties such as but not limited to teflon or stainless steel, and a shape of the body portion 20 is obtained by turning or grinding process or by molding process.

The body portion 20 tightly coupled or attached to a cutting portion 22 serves to link a conditioner of the present invention to a motor rotating portion (not shown) of conditioning equipments. The body portion 20 can have a wide range of shapes. For example, if the body portion 20 is connected to the cutting portion 22 having geometrical protrusions raised above the surface of the body portion 20, the body portion 20 takes on a shape of a cup or a doughnut with flattened upper and lower surfaces. However the body portion 20 and its function is not necessarily required to realize the present invention. Indeed, in one of the preferred embodiments, the cutting portion 22 can be directly linked to the conditioning equipment without having the body portion 20. Accordingly, the preferred embodiments of the present invention have been made in view of the structure of the cutting portion 22, and more specifically in view of the shapes and arrangements of the surface structure.

Preferred Embodiment 1

FIGS. 2A to 2F show a conditioner having a disk shape according to a first preferred embodiment of the present invention. The conditioner comprises a body portion 20, a cutting portion 22, and a substrate 50.

Figure 8A:
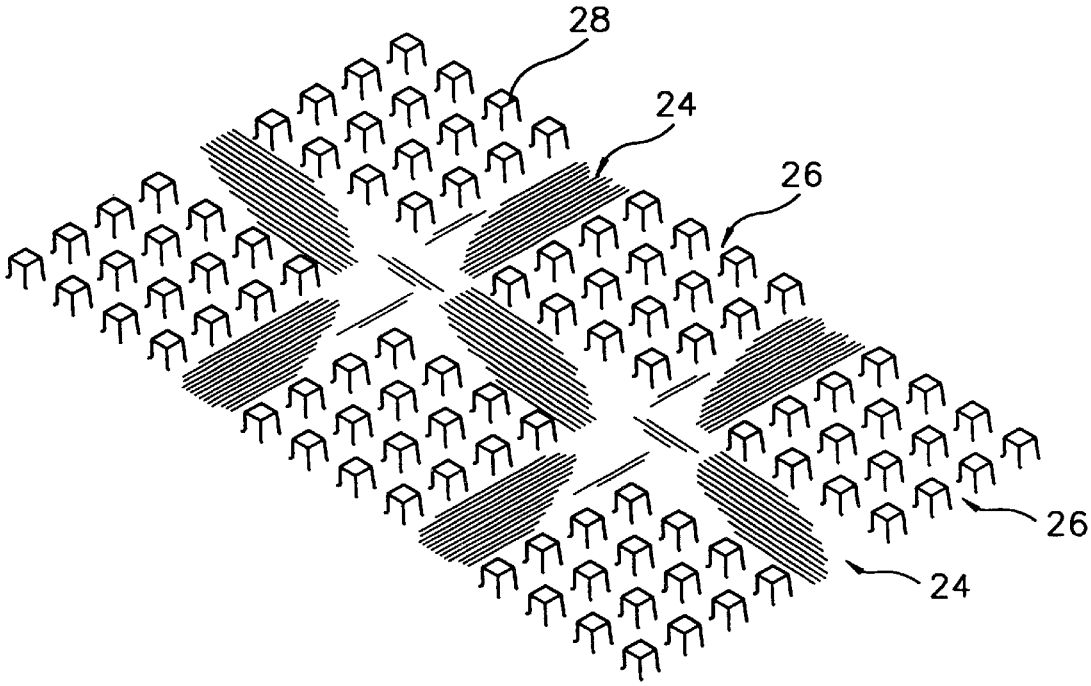
FIGS. 8A and 8B are enlarged perspective and cross-sectional views of the conditioner illustrated in FIG. 2A, showing a surface structure of a cutting portion having regionally grouped rectangular geometrical protrusions.
Figure 8B:
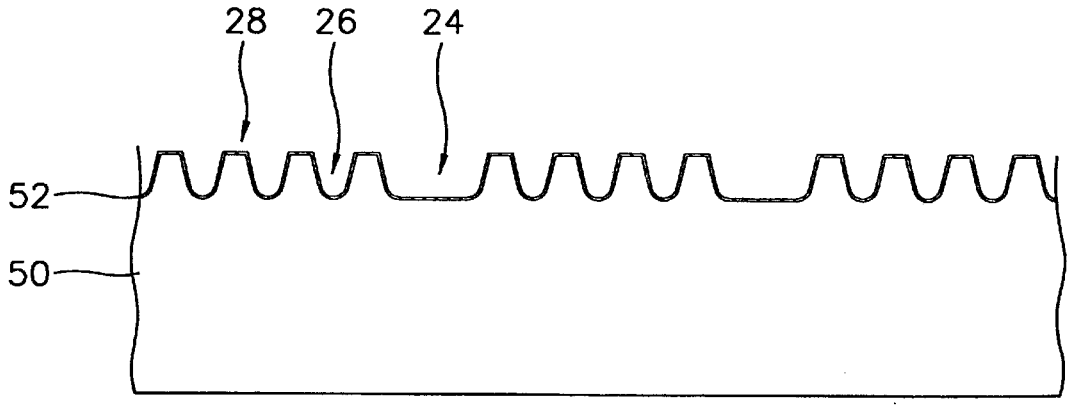

As shown by FIGS. 2A to 2D, the cutting portion 22 has a plurality of rectangular geometrical protrusions 28 formed in regional units of crossed-strip pattern on a surface of the substrate 50. FIGS. 8A and 8B are enlarged perspective and cross-sectional views which closely show the crossed-strip pattern of the rectangular geometrical protrusions 28 of the cutting portion 22.

The substrate 50 is preferably made from a ceramic material such as Si or $Si_3N_3$, or from at least one ceramic material selected from the group consisting of $Al_2O_3$, AlN, $TiO_2$, ZrOx, $SiO_2$, SiC, SiOxNy, WNx, Wox, DLC (diamond like coating). BN, and $Cr_2,O_3$. Alternatively, the substrate 50 can be made from a cemented carbide material such as tungsten carbides (WC) selected from the group consisting of tungsten carbonate-cobalt (WC—Co), tungsten carbonate-carbon titanium-cobalt (WC—TiC—Co), and tungsten carbonite-carbon titanium-carbon tantalium-cobalt (WC—TiC—TaC—Co). The substrate 50 can also be made from other cemented carbide materials such as TiCN, $B_1C$, or $TiB_2$.

The substrate 50 preferably has a disk shape, but it can have a shape of a plate having multiple corners, and it is important that the substrate 50 has a smooth surface exhibiting uniform degree of roughness, since the shape of the rectangular geometrical protrusions 28 must be maintained after a diamond layer 52 has been formed on a whole surface of the substrate 50 to obtain a conditioner having a highly effective cutting ability.

The rectangular geometrical protrusions 28 having an uniform height are formed on one side of the substrate 50 by recessed crossed-strips of ditches 24 and 26 having a cross-sectional profile of U-shape. More specifically, side and bottom portions of recessed ditches 24 and 26 has a rounded shape and their width gradually decreases toward the bottom portion to give the rectangular geometrical protrusions 28 a broader and thicker base. As a result, the rectangular geometrical protrusions 28 having such structure strengthen a rigid and brittle nature desired for the substrate surface. Alternatively, the ditches 24 and 26 has a cross-sectional view of V-shape.

The ditch 24 is a region dividing ditch and the ditch 26 is a cell dividing ditch which divides or separates each rectangular geometrical protrusions 28 on the substrate surface. As shown on FIGS. 2A to 2D, the region dividing ditch 24 which has a greater width and or depth than that of the cell dividing ditch 26 is placed in a regular interval of a certain number of the cell dividing ditch 26. For example, as shown in FIGS. 2A to 2D, the ditch 24 can be placed at every fourth ditch in both crossing directions to regionally divide the rectangular geometrical protrusions into a group of 4×4. Here, the ditches 24 and 26 functions to drain particle residues from polishing pads during the conditioning process.

As shown in FIG. 2A, a region diving ditch 25 having an even greater width and or depth than the ditches 24 and 26 can be placed at a center of the substrate surface in crossed-strips to more effectively drain the particle residues.

The diamond layer 52 covering the whole surface of the substrate 50 is thinly and uniformly formed on the surfaces of the rectangular geometrical protrusions 28 and the ditches 24, 25 and 26 of the cutting portion 22.

Figure 15:
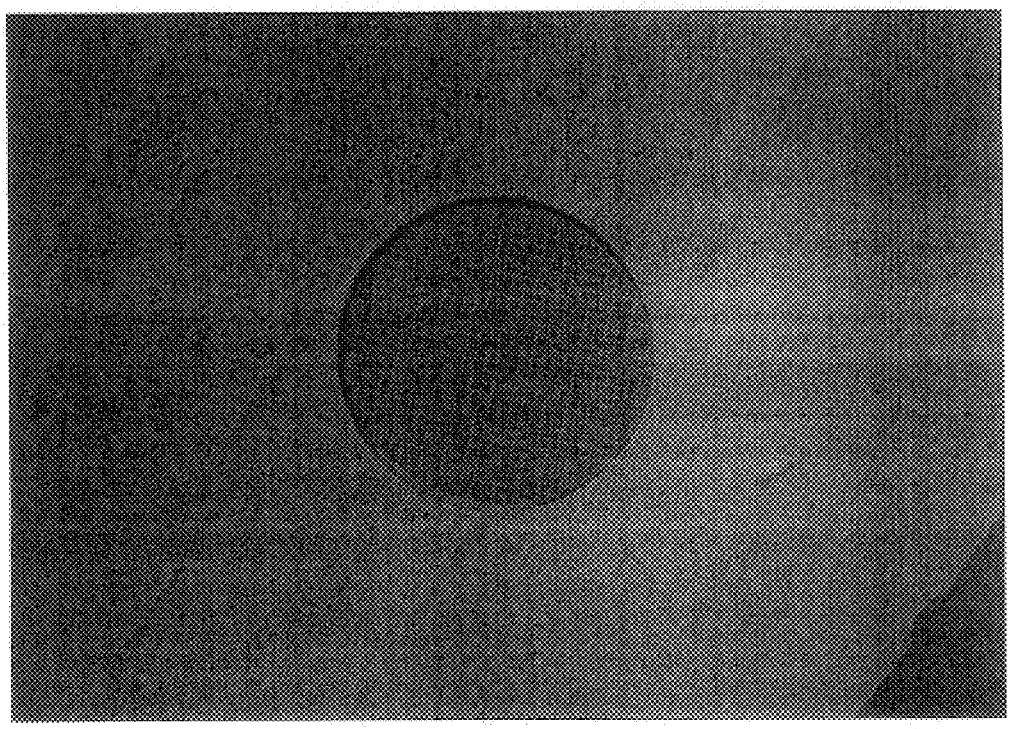
FIG. 15 is an actual photograph which shows a cutting portion of a conditioner manufactured by method of the present invention.

FIG. 15 is an actual photograph which shows the cutting portion 22 manufactured by method just described above. The cutting portion 22 has a diameter and thickness of 100Φ×4 t.

Figure 16A:
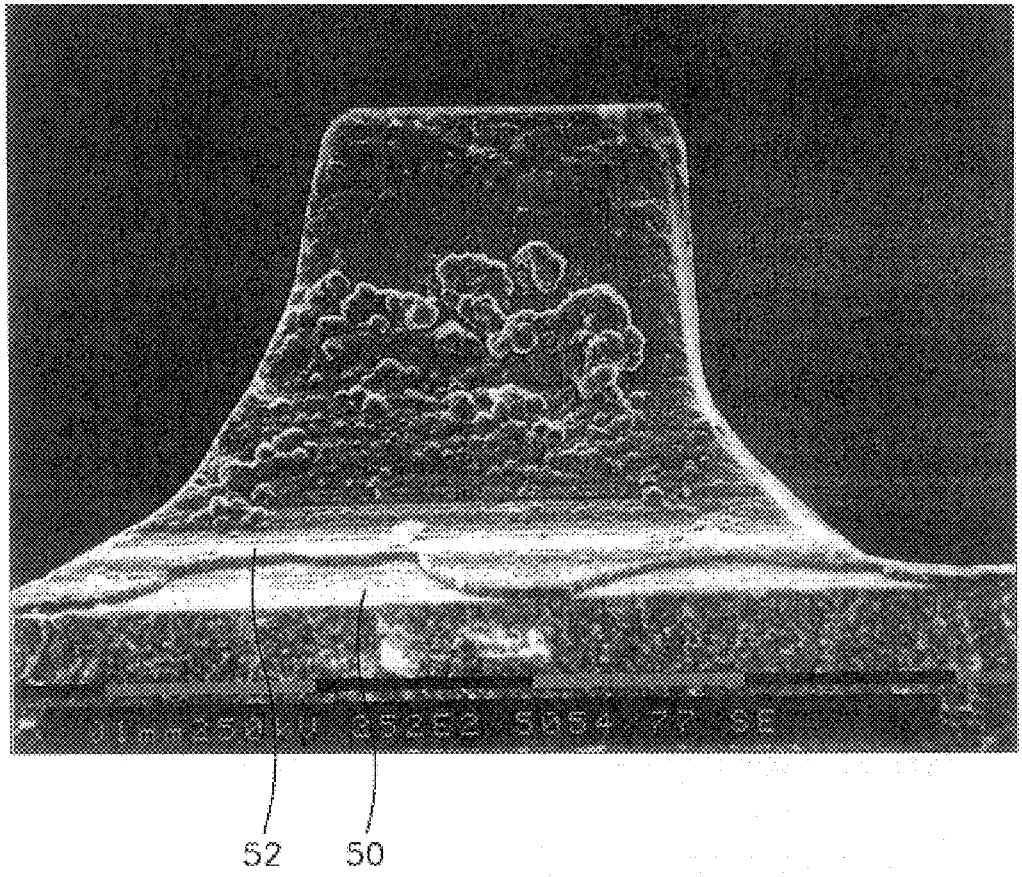
FIGS. 16A and 16B are electron-microscope photographs showing side and top-views of a rectangular geometrical protrusion formed on a cutting portion of a conditioner manufactured by method of the present invention.
Figure 16B:
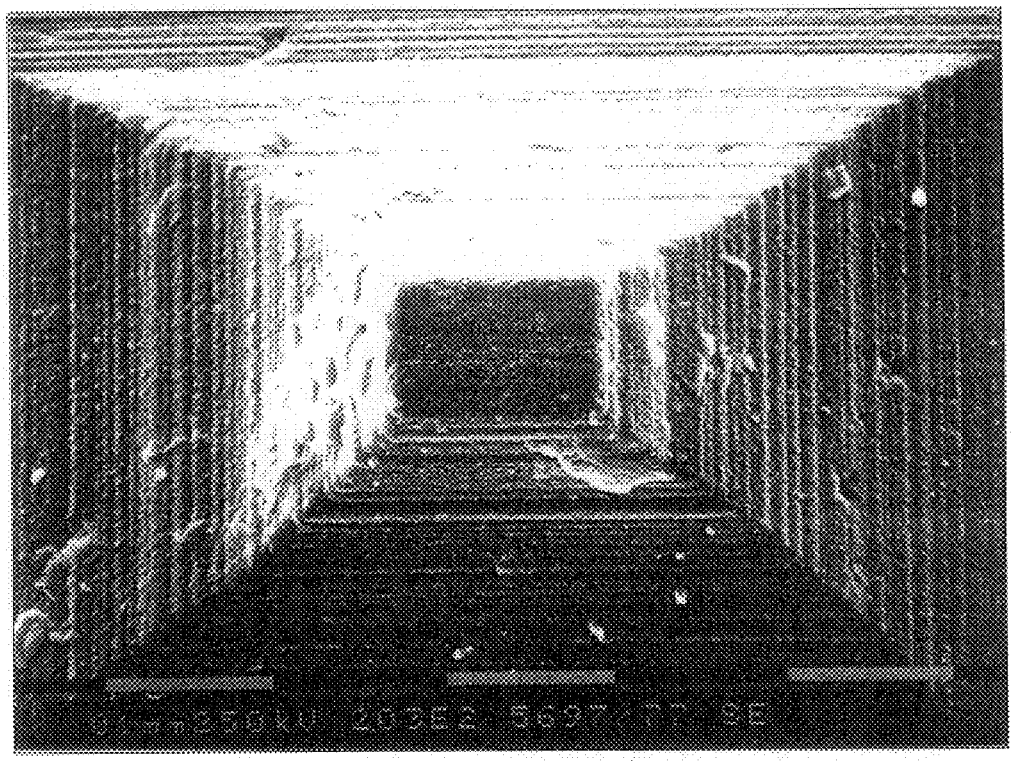
Figure 16C:
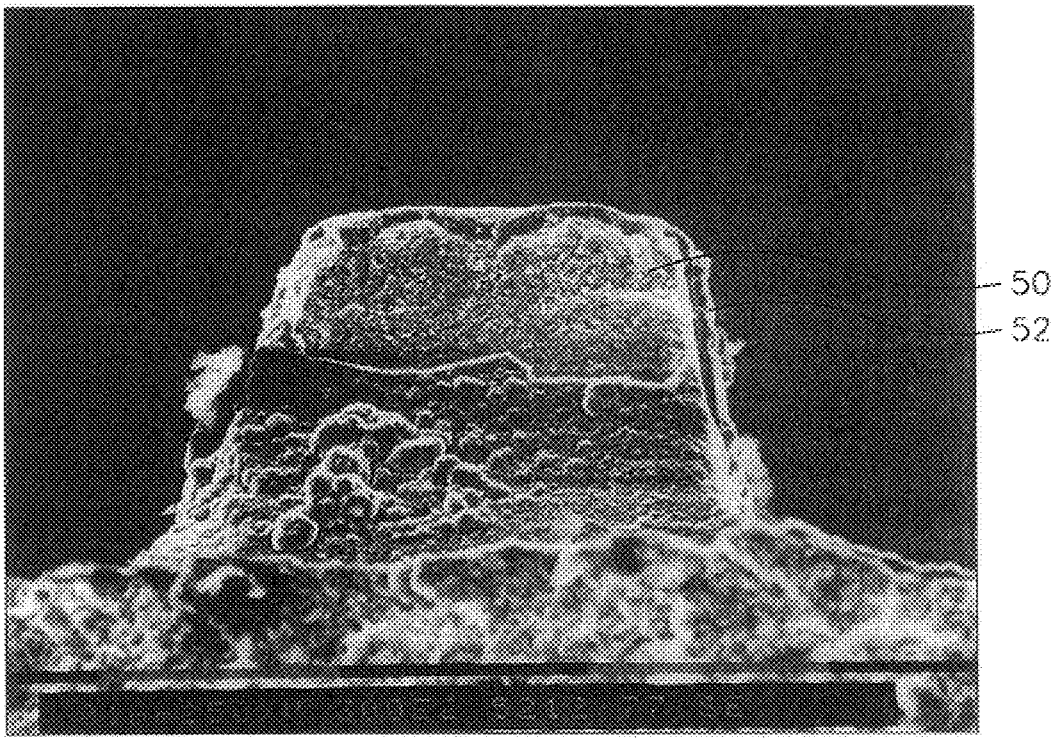
FIG. 16C is an electron-microscope photograph showing a side view of a rectangular geometrical protrusion on which a portion had been chipped away to distinguish and illustrate a diamond layer formed on a substrate manufactured by method of the present invention.

FIGS. 16A to 16C are electron-microscope photographs showing the rectangular protrusion 28 having coated with the diamond layer 52 of the cutting portion 22 of the present preferred embodiment. FIGS. 16A and 16B show side and top-views of the rectangular geometrical protrusion 28, while FIG. 16C shows another side view of the rectangular geometrical protrusion 28 on which a portion had been chipped away to visually distinguish and illustrate the diamond layer 52 formed on the surface of the cutting portion 22 of the substrate 50. As it can be seen from the electron-microscope photographs, the diamond layer 52 deposited on the surfaces of the rectangular geometrical protrusion 28 and the ditches 24 and 26 of the substrate 50 has a thin and uniform thickness.

Preferred Embodiment 2

Figure 2E:
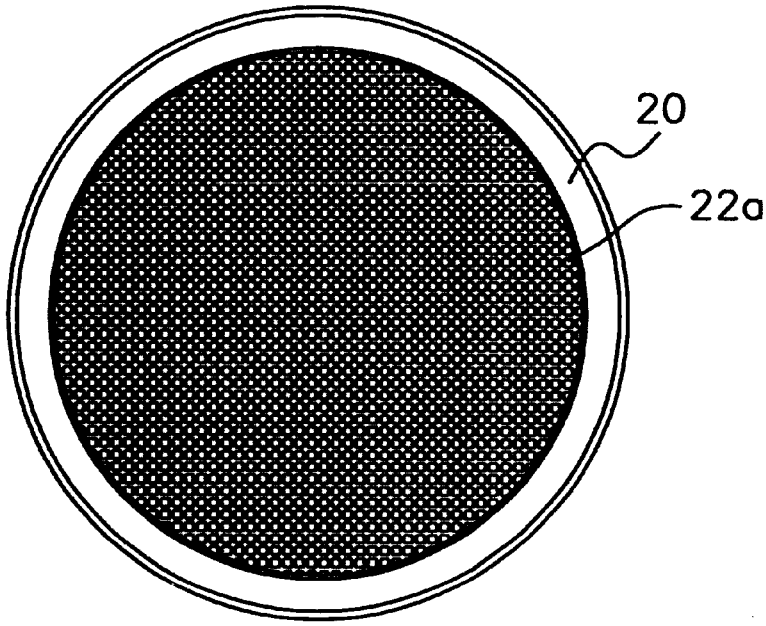
FIG. 2E is a plane-view of a conditioner manufactured from a substrate having a disk shape according to another preferred embodiment of the present-invention.
Figure 7A:
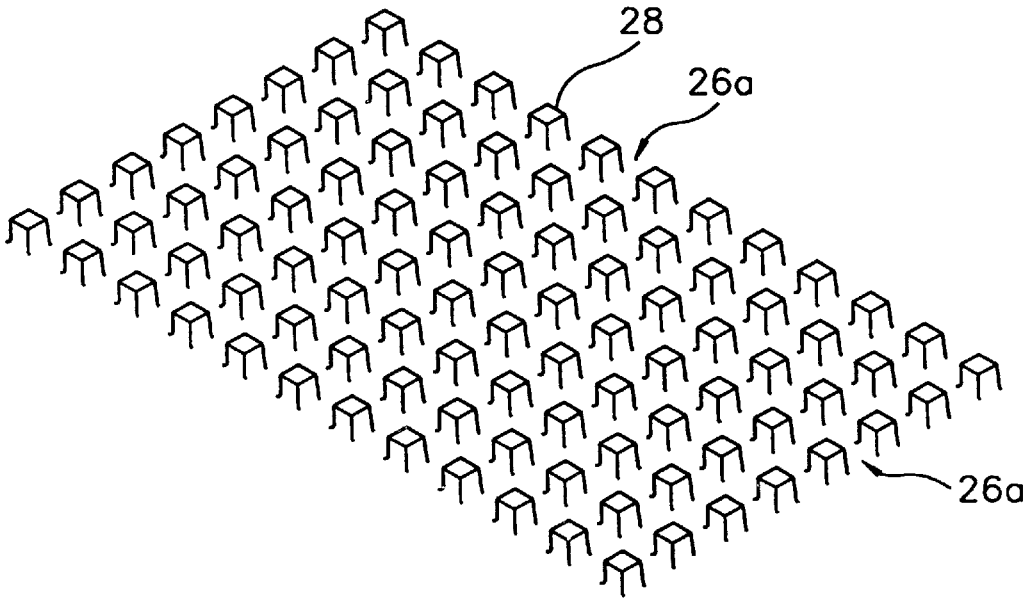
FIGS. 7A and 7B are enlarged perspective and cross-sectional views of the conditioner illustrated in FIG. 2E, showing a surface structure of a cutting portion having an uniform layout of a plurality of rectangular geometrical protrusions.
Figure 7B:
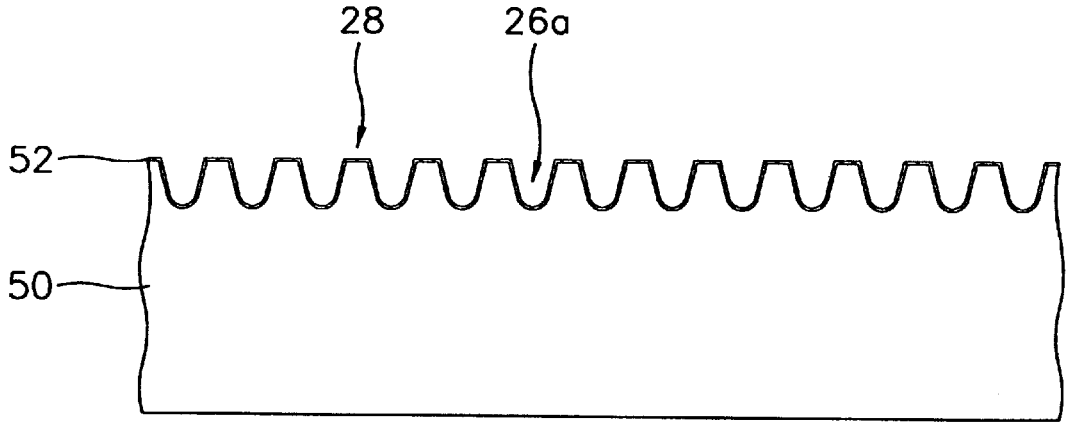

In the present embodiment, various and alternative arrangements the geometrical protrusions can have on the substrate surface are realized by varying the layout and structure of the ditches. As shown by FIG. 2E, the ditches of a same shape can be formed on a cutting portion 22*a* in the substrate surface by having a same width and or depth. FIGS. 7A and 7B show enlarged perspective and cross-sectional views of an arrangement of the geometrical protrusion formed by the ditches of FIG. 2E. For this arrangement, it is preferred that the ditches 26*a* has a greater width and or depth than that of the ditches 26 as shown in FIG. 2A for effectively draining the polishing pad residues from the surface of the cutting portion 22*a*.

Preferred Embodiment 3

Figure 2F:
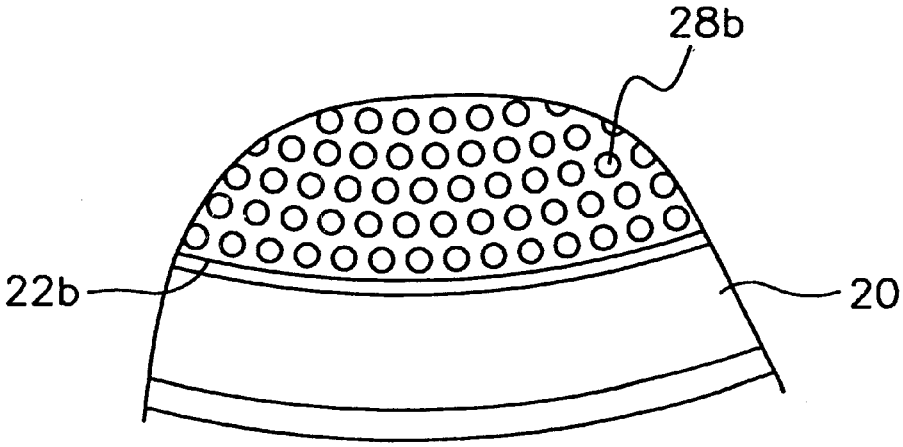
FIG. 2F is an enlarged plane-view showing body and cutting portions of a conditioner manufactured from a substrate having a disk shape according to yet another preferred embodiment of the present invention.
Figure 9A:
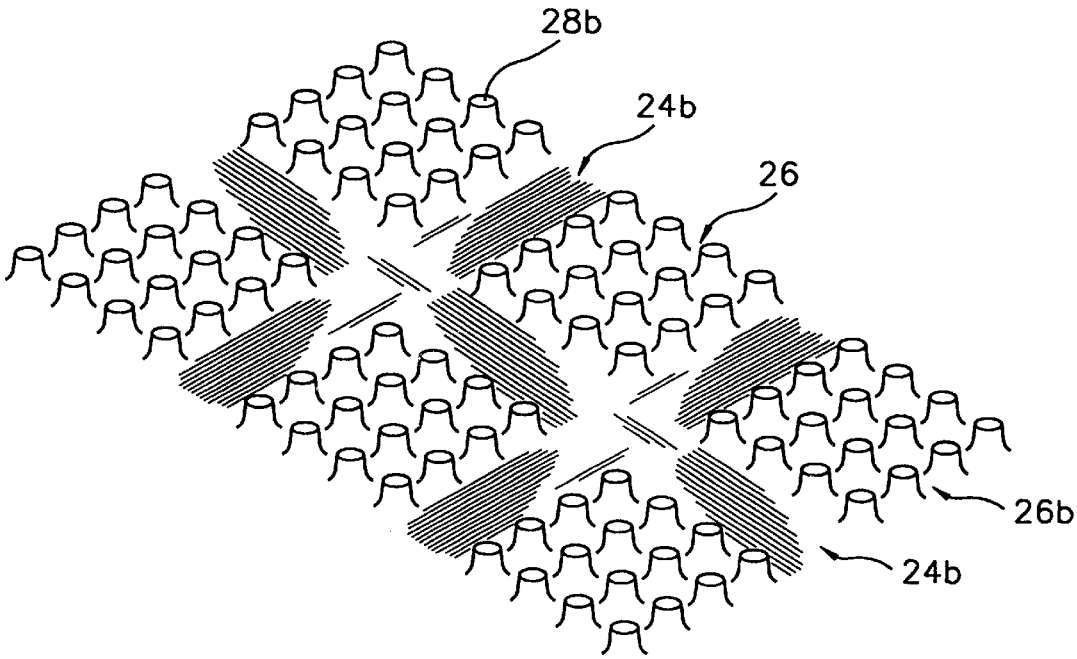
FIGS. 9A and 9B are enlarged perspective and cross-sectional views of a conditioner of the present invention, showing a surface structure of a cutting portion having regionally grouped cylindrical geometrical protrusions.
Figure 9B:
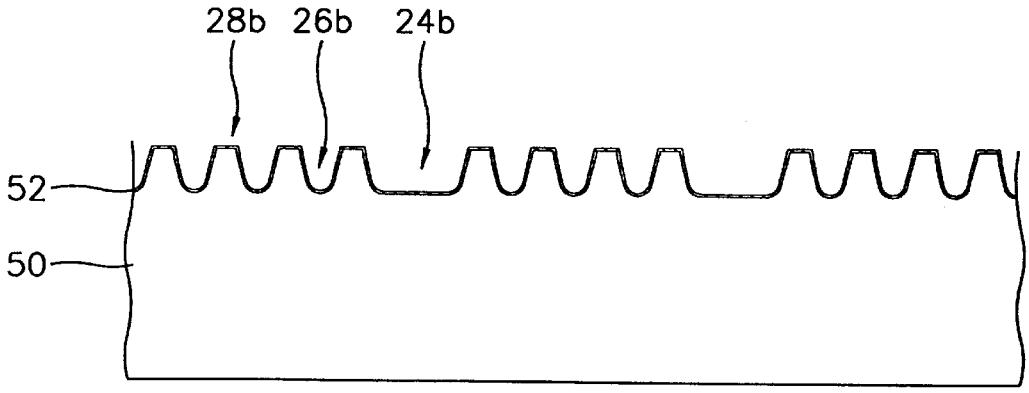

In the present embodiment, various shapes of the geometrical protrusions are realized. The shape of the geometrical protrusions 28 is not limited by rectangular shape, and alternatively, as shown by FIG. 2F, the geometrical protrusions 28*b* formed on a cutting portion 22*b* has a cylindrical shape. FIGS. 9A and 9B show enlarged perspective and cross-sectional views of the cutting portion 22*b* having formed with cylindrical geometrical protrusions 28*b*. Similar to the substrate having rectangular geometrical protrusions, the substrate having formed with cylindrical geometrical protrusions 28*b* on its cutting portion 22*b* has a diamond layer 52. The layout arrangement of the cylindrical geometrical protrusions 28*b* can have the same pattern illustrated in the first and second preferred embodiment or it can be realized by having a radial strip pattern expanding from the center of the substrate.

Preferred Embodiment 4

Figure 10A:
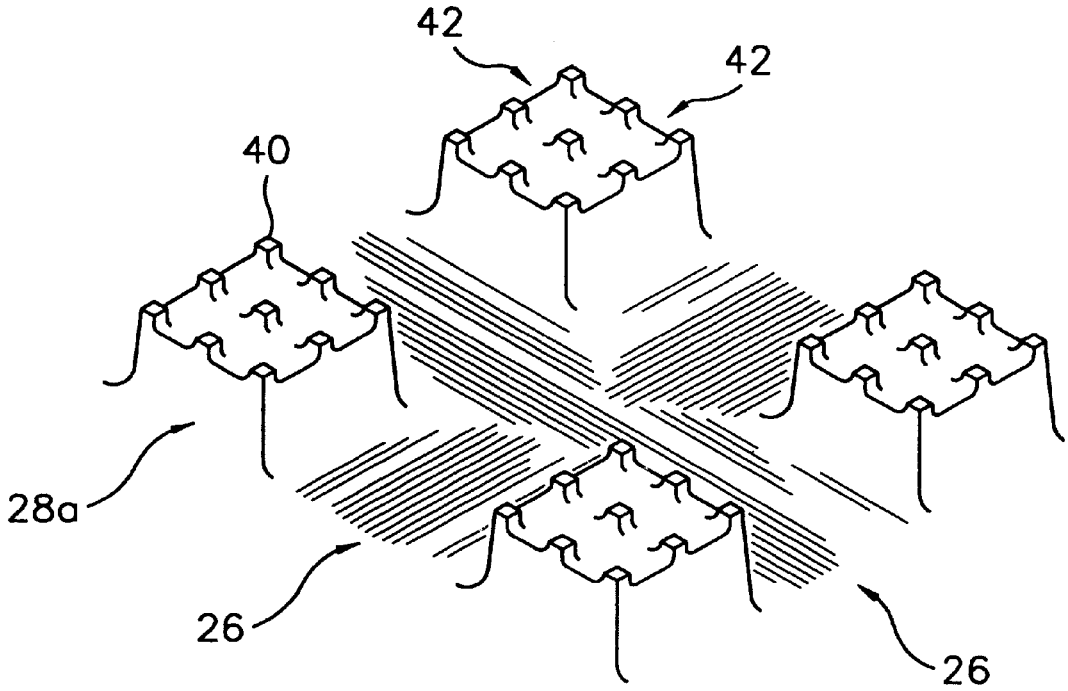
FIGS. 10A and 10B are enlarged perspective and cross-sectional views of rectangular geometrical protrusions of a conditioner of the present invention, showing a surface structure of the geometrical protrusions having formed with a plurality of smaller rectangular geometrical protrusions.
Figure 10B:
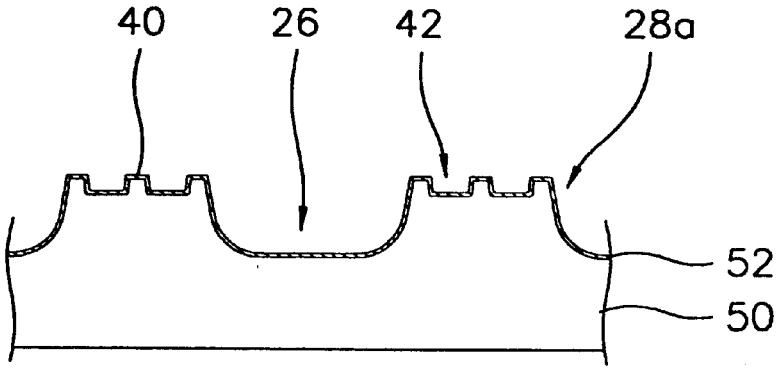

The geometrical protrusions of the previous preferred embodiments have a flat and even upper surface, but the present embodiment of the upper surfaces of the geometrical protrusions are formed with a plurality of smaller rectangular geometrical protrusions 40 having a crossed-strip pattern. FIGS. 10A and 10B show perspective and cross-sectional views of the rectangular geometrical protrusions 28*a* having formed with smaller rectangular geometrical protrusions 40 on their surfaces. As shown, the ditches 26 are the same as illustrated in the previous embodiments, and a diamond layer 52 is also coated on the surface of the substrate 50.

The smaller rectangular geometrical protrusions 40 are formed on the upper surfaces of the rectangular geometrical protrusions 28*a* of the substrate 50 by forming crossed-strips of recessed grooves 42. Similar to the ditches, the grooves 42 being round in its side and bottom portions have a cross-sectional profile of U-shape. A width of the grooves 42 decreases toward its bottom portion to give the smaller rectangular geometrical protrusions 40 a broader and thicker base. The rectangular geometrical protrusions 28*a* and the smaller rectangular geometrical protrusions 40 both having such a wider base structure attribute to strengthen a rigid nature desired for the substrate surface. Alternatively, the grooves 42 can have a cross-sectional view of V-shape. The presence of the smaller rectangular geometrical protrusions 40 will more effectively drain the polishing pad residues from the surface of the resulting conditioner to enhance the efficiency of the conditioning process.

It is preferred that the ditches and the grooves have an U-shape cross-sectional profile in contrast to V-shape. Generally, the ditches and grooves having the U-shape cross-sectional profile are more efficient in draining conditioning residues from the substrate surface simply due to their wider bottom portions. Further, in addition to the cross-sectional shapes of the ditches and grooves, the draining efficiency is also affected by the size and layout pattern of the ditches and grooves. Thus, various combinations of the above factors can be realized to obtain a desired draining efficiency.

Preferred Embodiment 5

Figure 11A:
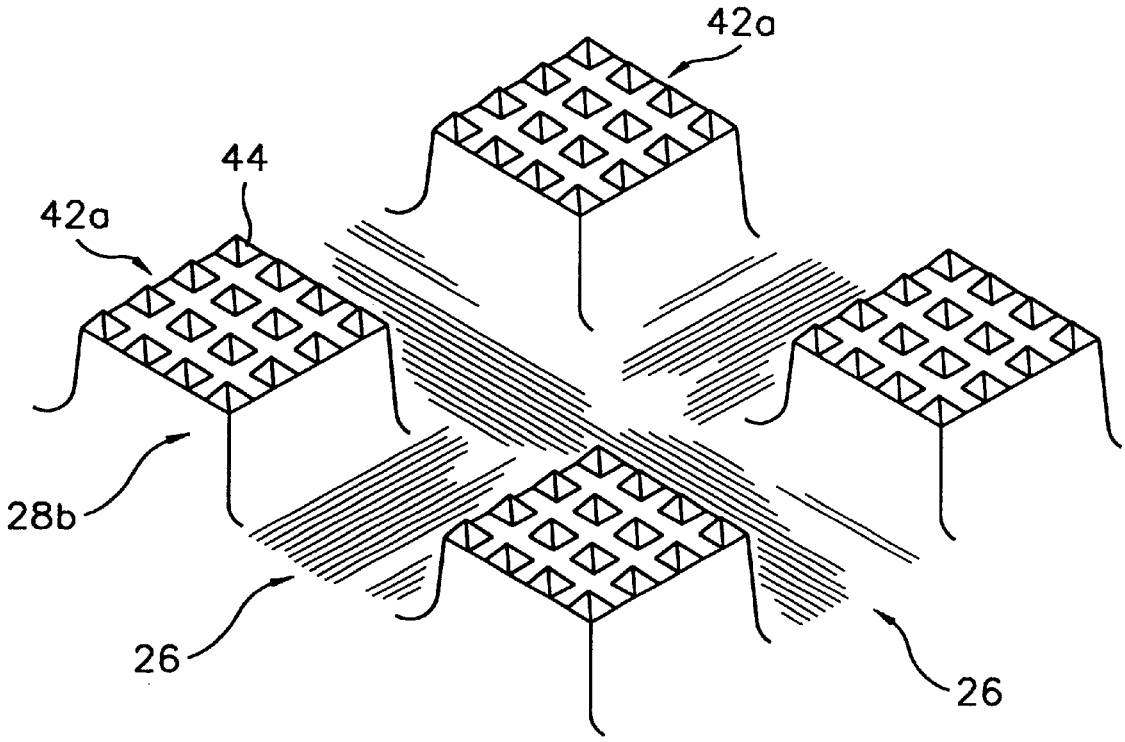
FIGS. 11A and 11B are enlarged perspective and cross-sectional views of rectangular geometrical protrusions of a conditioner of the present invention, showing a surface structure of the geometrical protrusions having formed with a plurality of smaller geometrical protrusions having a shape of rectangular pyramid.
Figure 11B:
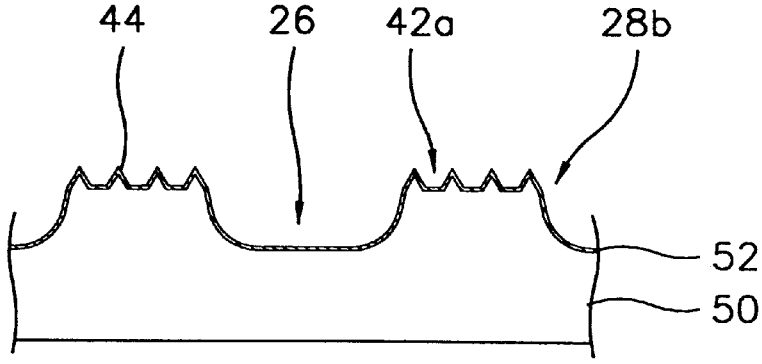

In the present embodiment, a plurality of smaller geometrical protrusions 44 having a shape of rectangular pyramid is formed on upper surfaces of the rectangular geometrical protrusion 28*b* of the substrate 50. As shown by FIGS. 11A and 11B, pointed upper ends of the smaller rectangular pyramid geometrical protrusions 44 are obtained by forming grooves 42*a* adjacent to each other in a crossed-strip pattern. Here, the pointed upper ends of the smaller rectangular pyramid geometrical protrusions 44 makes a point contact with the polishing pad surface during the conditioning process.

Figure 1A:
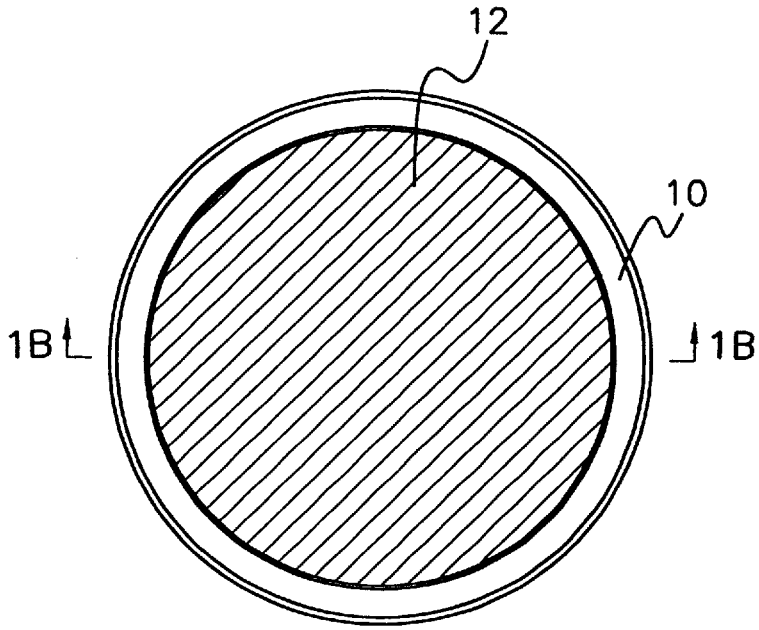
FIG. 1A (PRIOR ART)
Figure 1B:
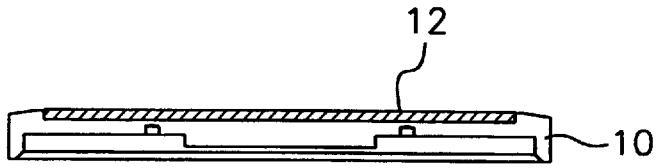
FIG. 1B (PRIOR ART)
Figure 1C:
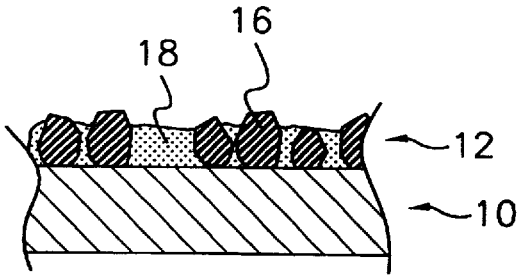
FIG. 1C (PRIOR ART)

The cutting efficiency of a conditioner having the rectangular geometrical protrusions with flat upper surfaces is higher by making line or surface contacts with the polishing pad surfaces as opposed to a conditioner that makes a point contact. However, because of an uniform height and size of the smaller rectangular pyramid geometrical protrusions 44 formed on the upper surfaces of the rectangular geometrical protrusions, which is different from the irregular height of the cutting surface of the conventional conditioner shown in FIG. 1C, the cutting efficiency of a conditioner realized by the present embodiment which make a point contact with the polishing pad surface is not significantly lower than the conditioners which make line or surface contacts.

Preferred Embodiment 6

Figure 12A:
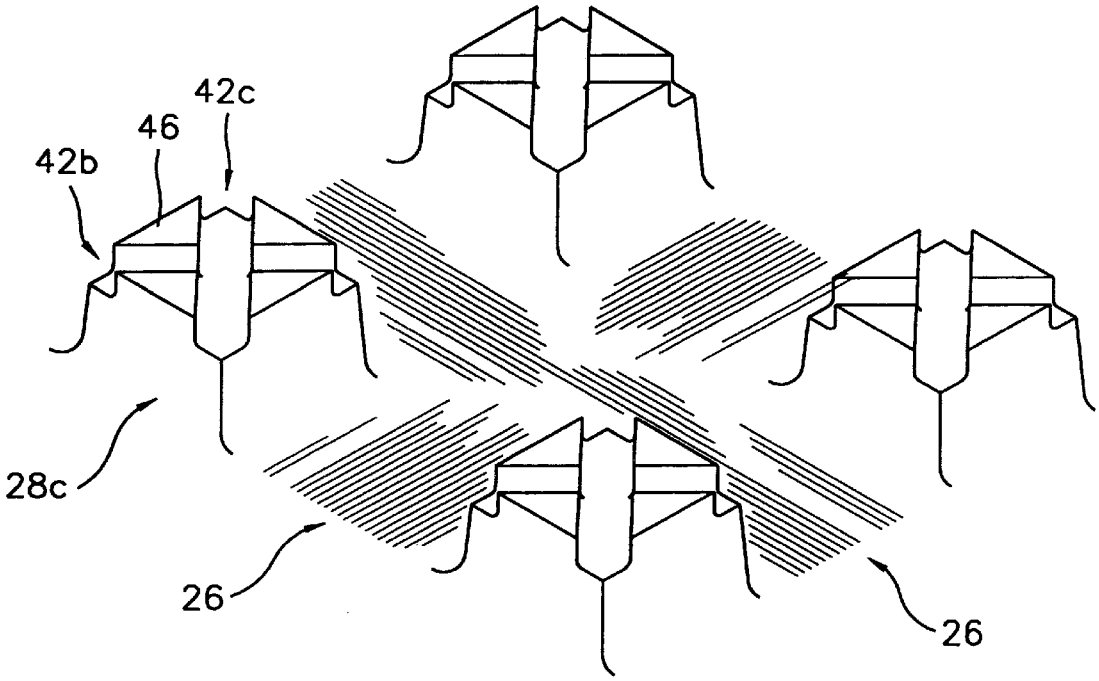
FIGS. 12A and 12B are enlarged perspective and cross-sectional views of rectangular geometrical protrusions of a conditioner of the present invention, showing a surface structure of the geometrical protrusions having formed with smaller triangular geometrical protrusions by a pair of diagonally-crossed grooves.
Figure 12B:
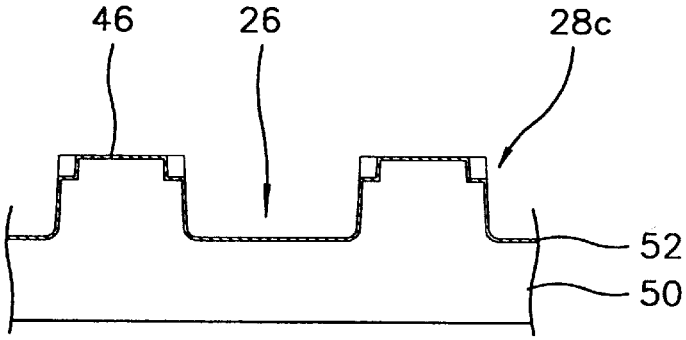

In the present embodiment, a four smaller geometrical protrusions 46 having a triangular shape are formed on upper surfaces of each rectangular geometrical protrusions 28*c* of the substrate 50 by diagonally crossed grooves 42*b* and 42*c*. FIGS. 12A and 12B are perspective and cross-sectional views showing the present embodiment. In terms of draining effectiveness and making contact with the polishing pad surface, the present embodiment having the rectangular geometrical protrusions 28*c* formed with smaller triangular geometrical protrusion 46 on their surfaces exhibits better draining than the rectangular geometrical protrusions 28 having flat upper surface and makes more contact with the polishing pad surface than the rectangular geometrical protrusions 28*a* and 28*b* having respectively formed with smaller rectangular geometrical protrusions 40 and smaller rectangular pyramid geometrical protrusions 44.

Preferred Embodiment 7

In the previous embodiments, the geometrical protrusions 28, 28*a,* 28*b* and 28*c* have been formed on one surface side of the substrate 50 having a shape of a disk or a plate with multiple corners. However, the present invention can also be realized by implementing substrates having difference shapes. In the present embodiment, a substrate 50*a* has a shape of a doughnut with flattened upper and lower surfaces.

Figure 3A:
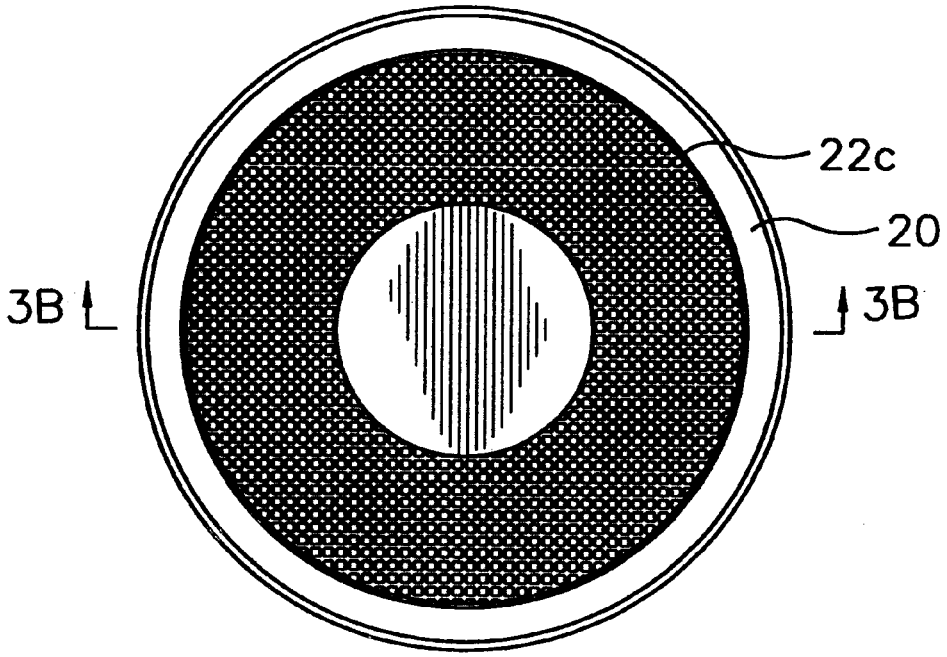
Figure 3B:
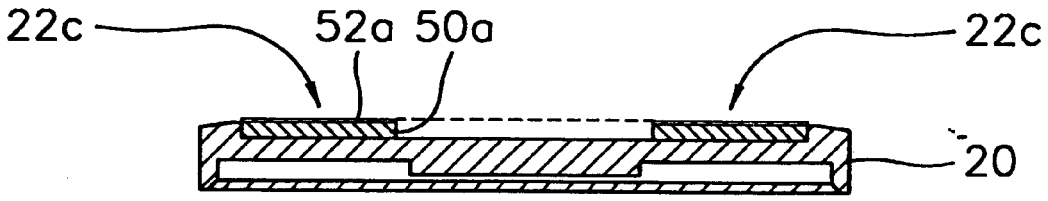

FIGS. 3A and 3B show plate and cross-sectional views of the substrate 50*a* having a ring-shape cutting portion 22*c* on which the geometrical protrusions 28, 28*a,* 28*b* or 28*c* described earlier are formed. Alternatively, a substrate can have a shape of a doughnut with one of its open surfaces enclosed to take on a shape of a cup.

Figure 5A:
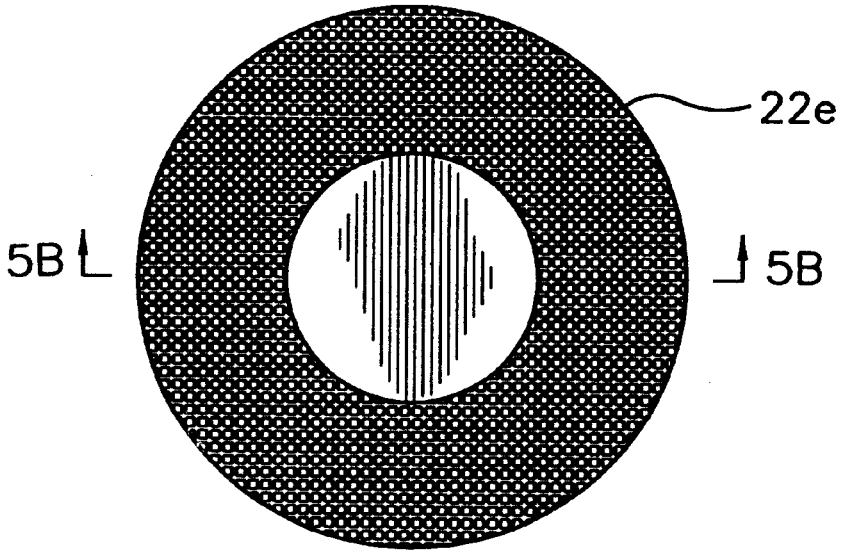
Figure 5B:
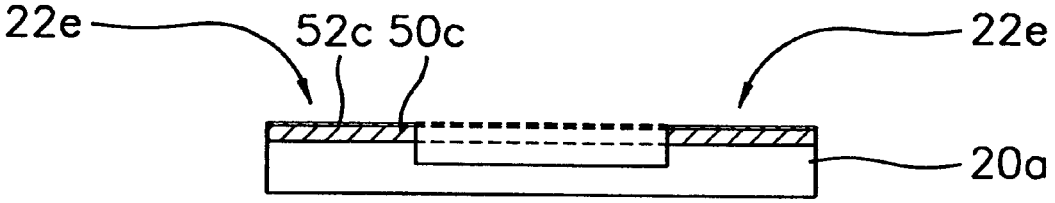

FIGS. 5A and 5B are plane and cross-sectional views showing a conditioner having a shape of a cup, in which a substrate 50*c* having a shape of a doughnut with flattened upper and lower surfaces and being formed with a diamond layer 52*c* on a surface of a cutting portion 22*e* is attached to an upper surface of a body portion 20*a* having a shape of a cup.

Preferred Embodiment 8

Figure 4A:
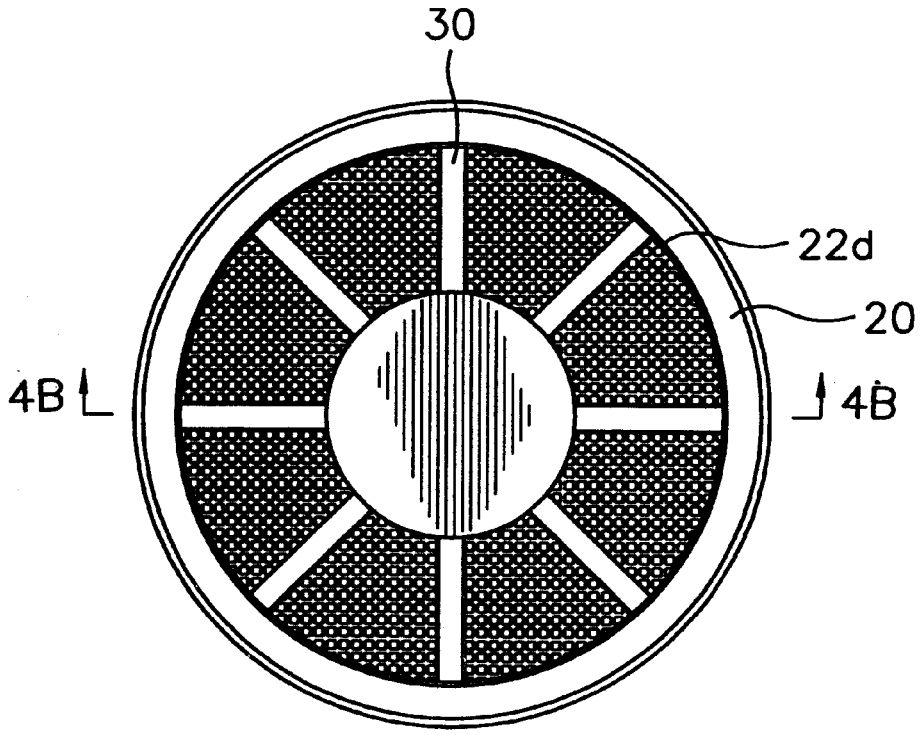
Figure 4B:
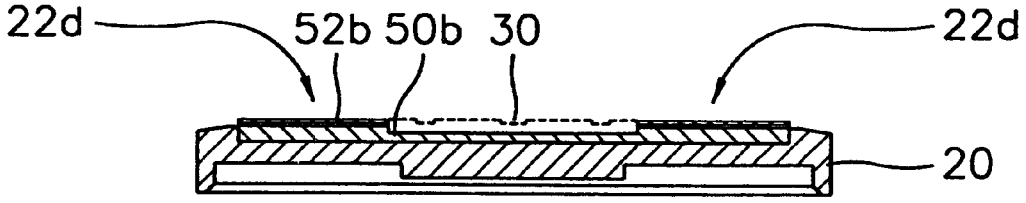

In the present embodiment, a conditioner having segmented cutting portions is realized. As shown by FIGS. 4A and 4B, a substrate 52*b* having a shape of a doughnut with flattened upper and lower surfaces or a doughnut with one of its open surfaces enclosed has a number of segmented cutting portions 22*d* formed by recessed valleys radially expanding from a center of the substrate 52*b*. The segmented cutting portions 22*d* are formed with the geometrical protrusions 28, 28*a,* 28*b* or 28*c,* and the substrate 52*b* further comprises a diamond layer 52*d*.

Figure 6A:
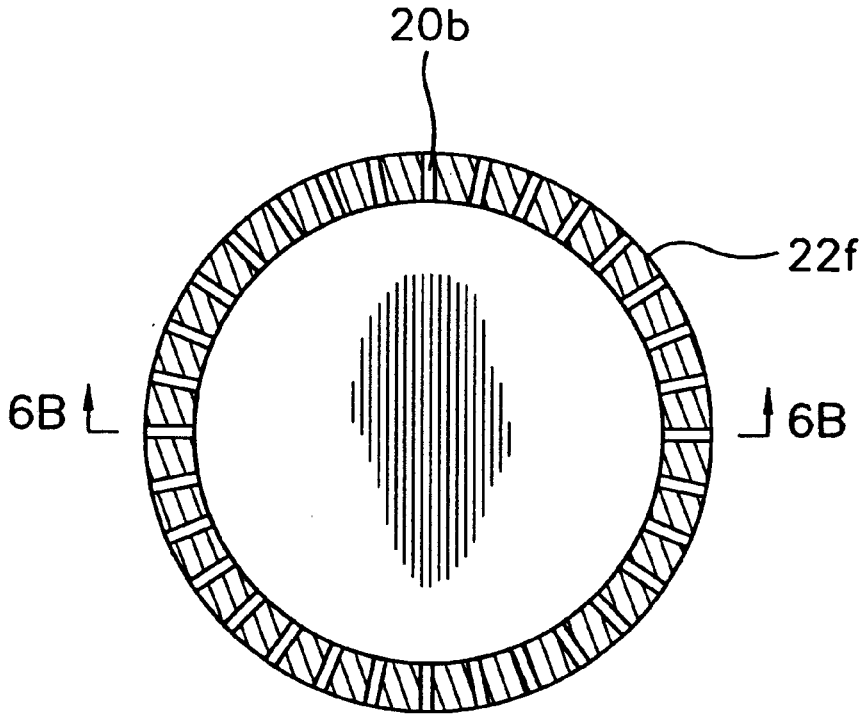
Figure 6B:
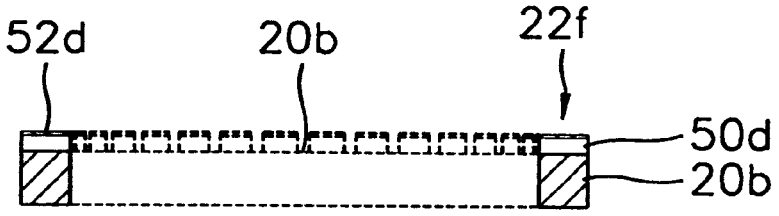

FIGS. 6A and 6B show another variation of segmented cutting portions. A number of independent segmented cutting portions 22*f* fabricated from their respective substrates 50*d* and separated from each other in a certain distance are fixedly attached on a surface of a body portion 20*b* to take on a shape of a belt. The body portion 20*b* has a shape of a doughnut with flattened upper and lower surfaces or a shape of a doughnut with one of its open surfaces enclosed, and the substrates 50*d* each having segmented cutting portions 22*f* are coated with a diamond layer 52*d*.

In the above preferred embodiments, the geometrical protrusions having rectangular or cylindrical shapes have been exemplified. However, the geometrical protrusions can be realized with a wide range of shapes such as triangle or hexagonal shapes. Similarly, in the preferred embodiments, the rectangular geometrical protrusions preferably having a square shape have been exemplified, however, the geometrical protrusions can also be realized with various forms of four sided figure such rhombus.

Herein below, a method for manufacturing the preferred embodiments of a conditioner for polishing pad according to the present invention will now be described in detail with reference to the attached drawings.

First, a method for manufacturing a first preferred embodiment of a conditioner according to the present invention will be described below.

FIGS. 13A to 13D are cross-sectional views illustrating a method for manufacturing a cutting portion 22, shown in FIGS. 10A and 10B, having the rectangular geometrical protrusions 28*a* being formed with smaller rectangular geometrical protrusions 40 on their surfaces.

First, a substrate 50 having a shape of a disk is made from the ceramic or cemented carbide materials recited earlier, than the substrate 50 is subjected to a fabrication process to obtain a diameter and thickness of 100Φ×4 t.

Next, one of the sides of the substrate 50 to be formed with a cutting portion is surface processed by rough and fine grinding processes utilizing a diamond wheel equipment to obtain an uniform and high degree of surface roughness, flatness, and parallelism. Then, the substrate 50 is subjected to a double-sided lapping process by utilizing a lapping equipment (not shown). Here, a cutting surface of the substrate 50 to be formed with rectangular geometrical protrusions is fine grinded until a high degree of flatness of 1 $\mu$m is obtained.

Figure 13A:
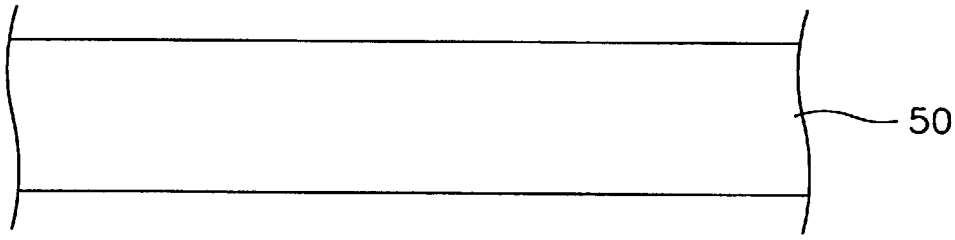
FIGS. 13A to 13D are cross-sectional views illustrating a method for manufacturing a cutting portion of a conditioner according to the present invention.
Figure 13B:
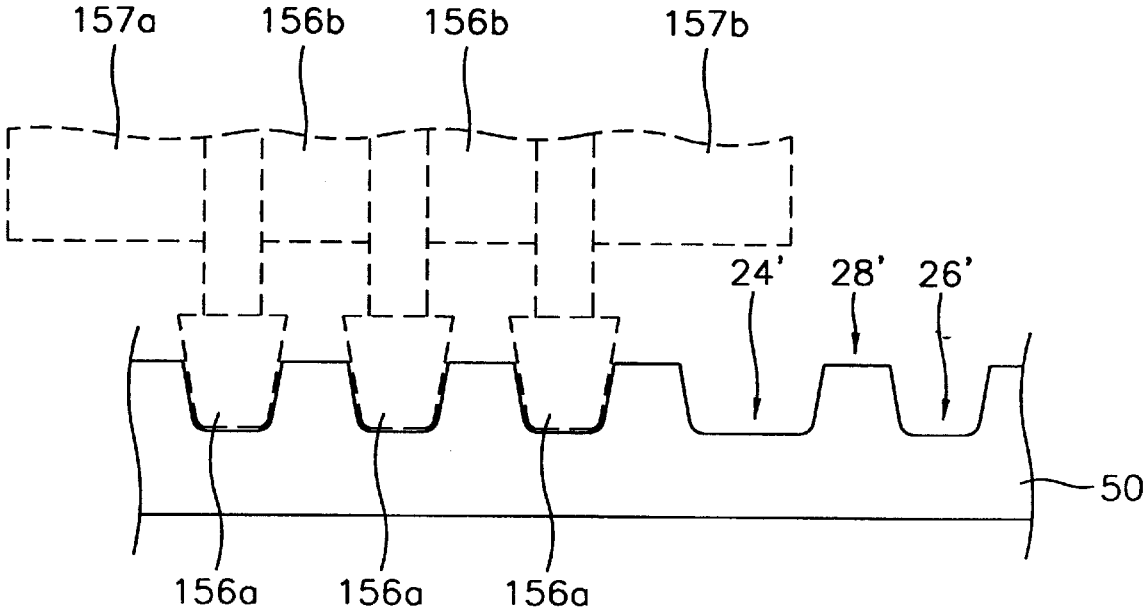

Then, as shown by FIG. 13B, crossed-strips of region dividing ditches 24' and cell dividing ditches 26' are formed on the cutting surface of the substrate 50 by utilizing a diamond wheel equipment shown in FIG. 4. The diamond wheel equipment comprises a motor 152, shafts 154*a* and 154*b,* and a wheel assembly 156 comprising diamond wheels 156*a,* spacers 156*b* placed between diamond wheels 156*a,* and flanges 157*a* and 157*b* placed at both ends of the wheel assembly 156. The thickness of the diamond wheels 156*a* is determined by width of the ditches 24' and 26' to be formed, and the shape of the diamond wheels 156*a* should be round to impart the ditches 24' and 26' with U-shape cross-section. Hence, the width of the ditches 24' and 26' decreases toward their bottom portion and gives the resulting geometrical protrusions 28*a* a thicker and broader base, which results in strengthening the rigid and brittle nature of the substrate 50 made from ceramic or cemented carbide materials. Further, the round U-shape cross-section of the ditches 24' and 26' provide an additional function of draining polishing pad residues from the cutting surface of the conditioner.

Typically, the diamond wheels 156*a* have a diamond blade portion having diamond particles bonded to an end of its disk-type body by metal or resin bonding, and a desired round curvature in the diamond layer of the diamond wheels 156*a* is better obtained when a resin bonded diamond wheel is used, as round curvature is more effectively obtained by removing resin bonding materials and diamond particles during a rounding process utilizing grinding stone.

The ditches 24' and 26' are formed by fixedly placing the substrate 50 on a processing platform 164, then the processing platform having the substrate 50 is upwardly moved toward the rotating diamond wheels 156*a* to be cut. After grinding, the substrate is rotated in 90 degrees and again fixed on the processing platform 164 to repeat the previous cutting process for forming crossed-strips of the 24' and 26'. Here, for forming the region dividing ditch 24', a diamond wheel 156*a* having a greater thickness than the diamond wheel 156*a* used for forming the cell dividing ditch 26' is utilized. Widths of the resulting rectangular geometrical protrusions 28*a* is controlled by a gap between the diamond wheels 156*a*. Specifically, as the gap between the diamond wheels 156*a* decrease, a more narrow rectangular geometrical protrusions 28*a* can be formed. However, it is preferred that a distance of the gap should not be less than the thickness of the diamond wheel 156*a* to prevent fracturing of the rectangular geometrical protrusions 28 during the fabrication process. FIG. 10A shows uniformly arranged rectangular geometrical protrusions 28*a* (prior to being formed with a diamond layer) formed by the above process. FIG. 15 is an actual photograph showing the rectangular geometrical protrusions formed on a cutting portion. The rectangular geometrical protrusions have a dimension of 190 $\mu$m (length) ×190 $\mu$m(width)×200 $\mu$m (height).

Figure 13C:
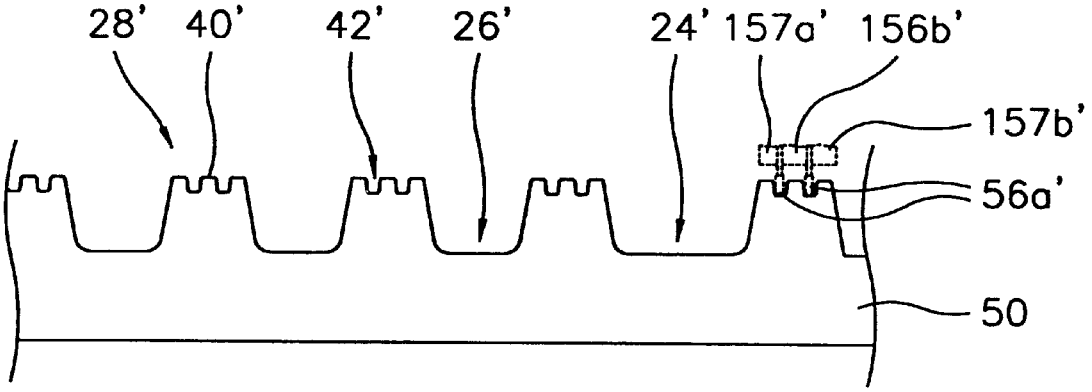

Referring to FIG. 13C, crossed strips of grooves 42' are formed on surfaces of the rectangular geometrical protrusions 28' to form a plurality of smaller rectangular geometrical protrusions 40' each having a dimension of 30 $\mu$m×30 $\mu$m ×30 $\mu$m by utilizing a diamond wheel 156*a* having a smaller thickness. Here, the length, width and height of the smaller rectangular geometrical protrusions 40' have same values, and similar to the rectangular geometrical protrusions 28', the smaller rectangular geometrical protrusions 40' have a thicker and wider base to strengthen and compensate the weak rigidness of substrates made from a ceramic material.

Edges of the smaller rectangular geometrical protrusions 40' having an uniformed height processed by the above process further increase the cutting ability of the resulting conditioner by making line contact with the polishing pad surface, and at the same time, the smaller rectangular geometrical protrusions 40' also increase the draining efficiency of the conditioner by assisting the drainage of slurry and particle residues from the cutting surface. Further, the rectangular geometrical protrusions 28' having such smaller rectangular geometrical protrusions 40' are effective in evenly distributing slurry during in-situ conditioning process.

Figure 13D:
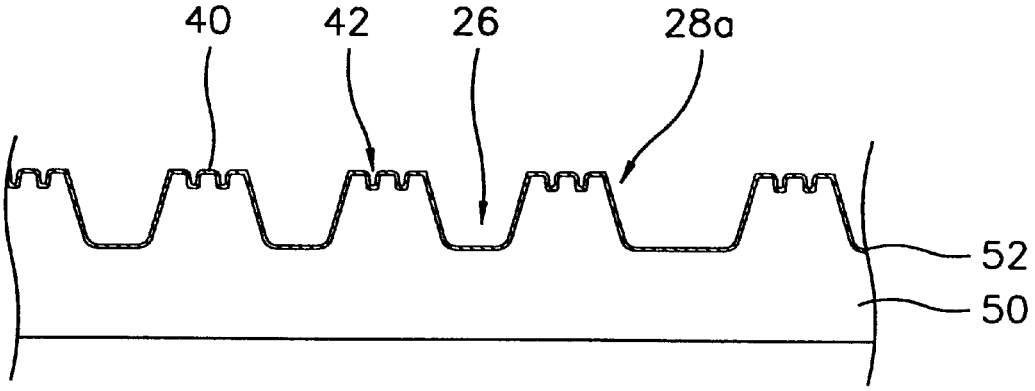
Figure 14:
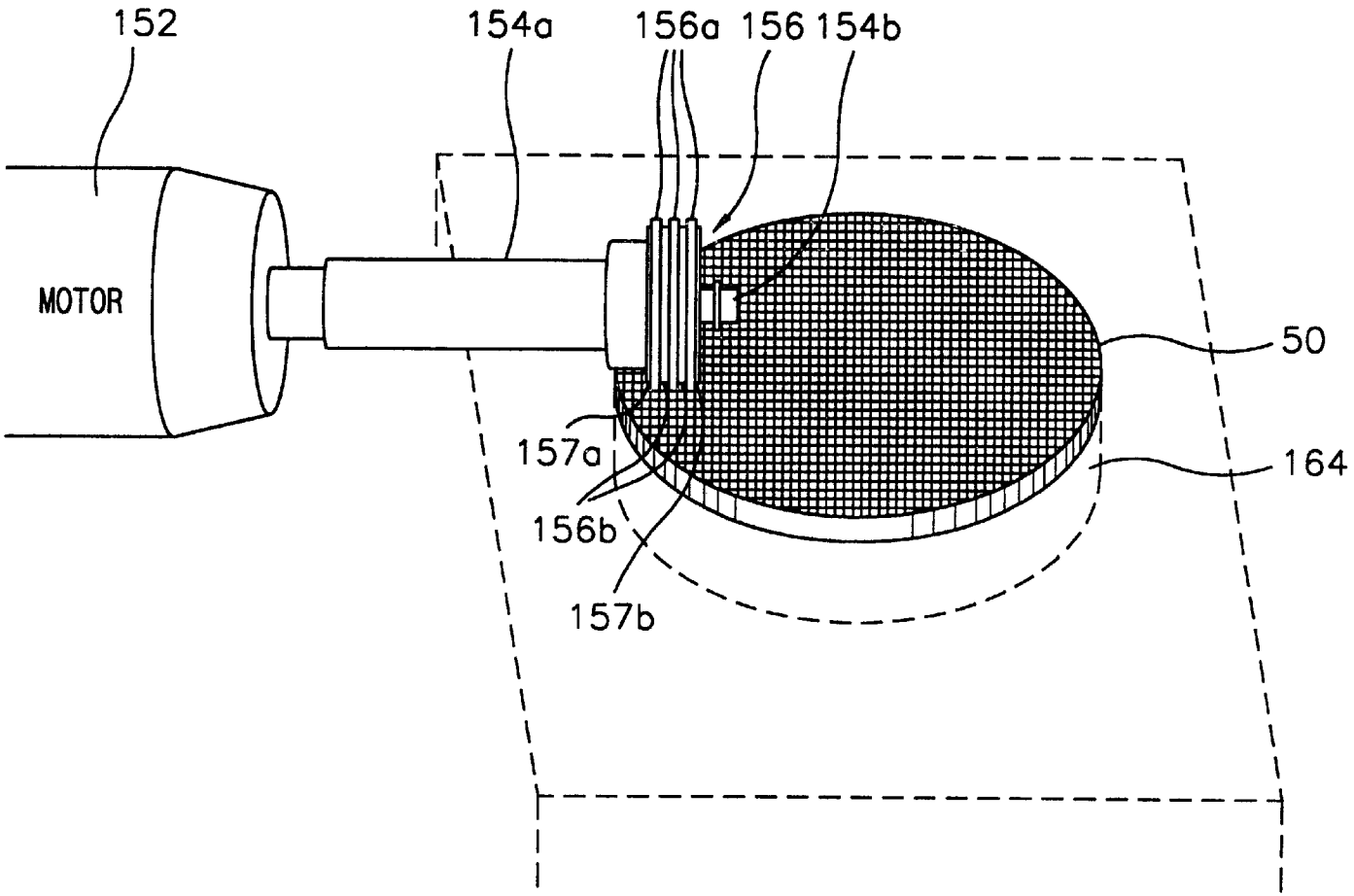
FIG. 14 is a view illustrating a diamond wheel attached to a polishing equipment for manufacturing a substrate.

As shown by FIG. 13D, after being formed with smaller rectangular geometrical protrusions 40', the substrate is then subjected to a chemical vapor deposition (CVD) process to form a diamond layer 52. A widely used conventional CVD equipment is utilized for the CVD process having the following conditions outlined in Table 1. A four inch $Si_3N$, substrate was utilized to deposit the diamond layer 52.

TABLE 1

| conditions for the CVD process | |
|---|---|
| Gas and Flow Rate | $H_2$ gas (1000 ml/min), $CH_4$ gas (20 ml/min) |
| Chamber Pressure | 10 Torr |
| Temperature of filament | 2200° C. |
| Applied Voltage | +100 Volt |
| Deposition Time | More than 8 hours |

A diamond layer 52 having a thin and uniform thickness strongly adhering to the surface of the substrate 50 was obtained. Because of the thin and uniform thickness of the diamond layer 52, the surface structure of the substrate 50 was maintained after the deposition process. The above conditions accompanying the chemical vapor deposition process represent one of the many suitable conditions which can be applied for the CVD process in the present invention.

After forming the diamond layer 52 on the substrate surface, a pre-fabricated body portion 20 is fixedly attached to the substrate 50. The body portion 20 functions to link the resulting conditioner to the conditioning equipments for better controlling the process of cutting the polishing pads. Alternatively, without compensating the function of the body portion 20, a conditioner can be realized without the body portion 20 as illustrated by the preferred embodiments.

The above method for manufacturing a conditioner has been described for the first preferred embodiment of the present invention. However, one skilled in art can manufacture other preferred embodiments of a conditioner by the method described above, such as the preferred embodiments shown and illustrated by FIGS. 2E, 3A, 4A, and 5A. Particularly, the preferred embodiment of the conditioner having a segmented cutting portions shown in FIG. 6A can be realized by subjecting a substrate 50 to a fine grinding process to obtain a highly leveled surface having a desired uniform roughness, followed by coating a diamond layer on the substrate 50 by CDV process. Then, the substrate 50 having the diamond layer is cut into independent segmented cutting portions which is fixed attached to the surface of the body portion 20 in an arrangement shown by FIG. 6A.

Further, the smaller rectangular pyramid geometrical protrusions 44 shown in FIGS. 11A and 11B can be obtained by selecting the diamond wheel 156*a* having an appropriate thickness and rounded curvature at its outer diamond layer. Similarly, the smaller triangular geometrical protrusions 46 shown in FIGS. 12A and 12B can be obtained by utilizing an appropriate diamond wheel 156*a*. The rectangular geometrical protrusions having a flat surface as shown in FIGS. 7A, 7B, 8A and 8B can be directly coated with the diamond layer 52 without being subjected to the process illustrated in FIG. 13C.

On the other hand, the cylindrical geometrical protrusions 23*b* shown in FIGS. 9A and 9B can be more effectively obtained by molding process, in which a substrate already being integrally formed with the cylindrical geometrical protrusions 28*b* is obtained by molding. The cylindrical geometrical protrusions 28*b* of the substrate is then subjected to a fine grinding process, directly followed by chemical vapor deposition process to be coated with a diamond layer. Similarly, a substrate having the rectangular geometrical protrusions can also be obtained by molding process.

More, the ditches and grooves of the present invention having an V cross-sectional shape can be realized by utilizing a diamond wheel having a rectangular end and by turning the substrate to be processed 45 degrees from its horizontal position.

A conditioner provided by the present invention exhibits an exceptional cutting ability and while its anti-wear and anti-corrosive properties being close to diamond renders the conditioner to have a prolonged lifetime usage. The geometrical protrusions of the cutting portion function as cutting blades and allows the conditioner to make point and surface contacts with the polishing pads in addition to its primary function of making a line contact. The diamond layer formed on the cutting surface provides the conditioner with exceptionally rigid and brittle properties. Specifically, the diamond layer strengthens the structural integrity of the cutting surface to decrease the wearing of the sharp edges of the cutting blades from polishing particles such as alumina, silica, and ceria from slurry. Further, by having the diamond layer coated on the cutting surface, the detachments of diamond particles from the cutting surface prevalent in the conventional conditioners can be eliminated, and metal ion contamination of the wafer circuits caused by corroded bonding metals from the surface of the conventional conditioners in metal CMP process can be prevented. Additionally, the diamond layer which has a thin and uniformed thickness provides consistent cutting performance while simultaneously increasing the grinding ability of the conditioner. More, the ditches and grooves having an U or V cross-sectional shapes further enhance the cutting efficiency of the conditioner by effectively draining residue particles from the cutting surface.

Hence, the conditioner provided by the present invention makes it possible to achieve and control a desired cutting performance and provides an advantage of accomplishing a highly effective conditioning without the presence of high pressure. As a result, a polishing pad having an uniformly conditioned surface can be obtained to decrease the occurrences of imparting micro-scratches on the wafer surfaces, thus the productivity of semiconductor wafers can be increased while the production cost is reduced by an extended life of the polishing pads conditioned by the conditioner of the present invention.

A method for manufacturing a conditioner according to the present invention is relatively simple and has a distinctive advantage of not being continued or limited in manufacturing conditioners having cutting portions of various shapes and sizes. In view of different degrees of surface roughness of polishing pads required to polish wafer circuits and wafers made from various types of materials, the method provided by the present invention enables the manufacturing of conditioners appropriate for the polishing pads having different degrees of surface roughness by adjusting and controlling the size of geometrical protrusions, the distance between the ditches, the distance between grooves, and the thickness of the diamond layer. Hence, the method for manufacturing a conditioner for polishing pad according to the present invention is much more flexible and adaptive than the conventional electro-deposition and braze methods.

While the present invention has been particularly shown and described with reference to particular embodiments thereof, it is understood that the present invention should not be limited to this preferred embodiment, but various changes and modifications can be made by one skilled in the art within the spirit and scope of the invention as hereinafter claimed.

What is claimed is:

1. A conditioner for polishing pad comprising:

a substrate having a plurality of geometrical protrusions of a uniform height on at least one of its sides, a top surface of each of the geometrical protrusions defining a flat surface, the geometrical protrusions being made of a material other than diamond; and a diamond layer of a uniform thickness coating substantially a whole surface of the side of the substrate having the geometrical protrusions.

2. A conditioner for polishing pad as claimed in claim 1, wherein the geometrical protrusions have a cylindrical shape.

3. A conditioner for polishing pad as claimed in claim 1, wherein the geometrical protrusions have a rectangular shape.

4. A conditioner for polishing pad as claimed in claim 3, wherein the geometrical protrusions are formed with a number of crossed-strips of grooves having U or V-shapes on their top surfaces.

5. A conditioner for polishing pad as claimed in claim 4, wherein the crossed-strips of grooves are formed spaced apart from each other to form smaller geometrical protrusions of a uniform height on the top surfaces of the geometrical protrusions.

6. A conditioner for polishing pad as claimed in claim 4, where the crossed-strips of grooves are formed adjacent to each other to form smaller geometrical protrusions of a uniform height on the top surfaces of the geometrical protrusions.

7. A conditioner for polishing pad as claimed in claim 1, wherein the geometrical protrusions formed on the surface of the substrate have a cross-strip pattern realized by crossing-strips of ditches having U or V cross-sectional shapes.

8. A conditioner for polishing pad as claimed in claim 1, wherein the geometrical protrusions formed on the surface of the substrate have a crossed-strip pattern realized by ditches that include first ditches, and second ditches having a greater depth and/or a greater width than the first ditches, where the second ditches are regularly disposed between a certain number of the first ditches and both the first and second ditches have U or V cross-sectional shapes.

9. A conditioner for polishing pad as claimed in claim 1, wherein the geometrical protrusions have a shape of a disk or a plate having multiple corners.

10. A conditioner for polishing pad as claimed in claim 1, wherein the substrate has a shape of a disk or a plate having multiple corners and at one of its sides a recessed inner portion and an outer ring portion raised above the inner portion to give the substrate a cross-sectional profile of a cup, wherein the outer ring portion includes other geometrical shapes other than of a circular shape and the geometrical protrusions formed on the substrate being located at an upper surface of the outer ring portion.

11. A conditioner for polishing pad as claimed in claim 1, wherein the substrate has a shape of a doughnut with flattened upper and lower surfaces.

12. A conditioner for polishing pad as claimed in claim 1, wherein the substrate has a shape of a disk or a plate having multiple corners and at one of its sides a recessed inner portion and an outer ring portion raised above the inner portion to give the substrate a cross-sectional profile of a cup, wherein the outer ring portion includes other geometrical shapes other than of a circular shape and has a number of segmented portions separated by valleys radially extending from a center of the substrate, and the geometrical protrusions formed on the substrate are located at upper surfaces of the segmented portions.

13. A conditioner for polishing pad as claimed in claim 1, wherein the diamond layer is formed by chemical vapor deposition (CVD).

14. A conditioner for polishing pad as claimed in claim 1, wherein the substrate is made from ceramic or cemented carbide materials.

15. A conditioner for polishing pad as claimed in claim 1, wherein the conditioner further comprises a body portion fixedly attached to the substrate at a side opposite to the side having the geometrical protrusions.

16. A conditioner polishing pad as claimed in claim 15, wherein the body portion has a cross-sectional profile of a doughnut having flat upper and lower surfaces or a doughnut with one of its open surfaces enclosed and has a number of independent segmented portions spaced apart in a certain distance and fixedly attached to one of surfaces of the body portion to take on a shape of a belt.

17. A conditioner for polishing pad as claimed in claim 15, wherein the body portion is made from at least one material selected from the group consisting of stainless steel, engineering plastic, and ceramic.

18. A conditioner for polishing pad comprising:

a substrate having a plurality of geometrical protrusions of a uniform height on at least one of its sides, the geometrical protrusions have a rectangular shape;

a diamond layer of a uniform thickness formed substantially on the entire surface of the side of the substrate having the geometrical protrusions; and being a conditioner for polishing pad as claimed in claim 3, wherein the geometrical protrusions are formed with a pair of diagonally-crossed grooves having U or V-shapes on their top surfaces.

19. A conditioner for polishing pad comprising:

a substrate having a plurality of geometrical protrusions made of a material other than diamond and of a uniform height on one of its sides, wherein the geometrical protrusions have a crossed-strip pattern realized by crossing-strips of ditches having U or V cross-sectional shapes; and a diamond layer of a thin uniformed thickness coating substantially the whole surface of the side of the substrate having the geometrical protrusions, and being formed by chemical vapor deposition (CVD).

20. A conditioner for polishing pad as claimed in claim 19, wherein the crossed-strip pattern of the geometrical protrusions comprises a first ditch and a second ditch having a greater depth and or a greater width than that of the first ditch, wherein the second ditch is regularly disposed between a certain number of the first ditches.

21. A conditioner for polishing pad as claimed in claim 19, wherein the substrate is made from ceramic or cemented carbide materials.

22. A conditioner for polishing pad comprising:

a substrate having formed with a plurality of geometrical protrusions in an uniformed height on one of its sides, wherein the geometrical protrusion has a crossed-strip pattern realized by crossing-strips of ditches having U or V cross-sectional shapes and has a plurality of smaller geometrical protrusions formed by strips of grooves on their upper surfaces; and a diamond layer of a thin uniformed thickness coated substantially on a whole surface of the side of the substrate having the geometrical protrusions by chemical vapor deposition (CVD).

23. A conditioner for polishing pad as claimed in claim 22, wherein the smaller geometrical protrusions formed on the upper surfaces of the geometrical protrusions have at least one plane-view shape selected from the group consisting of triangle, rectangle, and rectangular pyramid.

24. A conditioner for polishing pad as claimed in claim 22, wherein the substrate is made from ceramic or cemented carbide materials.

25. A conditioner for polishing pad as claimed in claim 22, wherein the geometrical protrusions are formed on a) a surface of at least one side of a substrate having a shape of a disk or a plate having multiple corners, b) a surface of a ring portion being raised above an inner portion of a substrate having a cup shape, c) a surface of at least one side of a substrate having a shape of doughnut with flat upper and lower surfaces, or d) a surface of segmented portions formed on the ring portion of the substrate having a cup shape or on a surface of segmented portions formed on one of the sides of the doughnut shape substrate.

26. A conditioner for polishing pad as claimed in claim 22, wherein the grooves formed on the upper surfaces of the geometrical protrusion have a crossed-strip pattern or a diagonally-crossed pattern.

27. A conditioner for polishing pad comprising:

a body portion having a shape of a doughnut or a cup;

a number of independent segmented cutting portions spaced apart in a certain distance and fixedly attached to one of surfaces of the body portion to take on a shape of a belt;

a substrate having a flat surface on which its respective independent segmented cutting portion is formed, wherein the substrate is made from ceramic or cemented carbide materials, the substrate having a plurality of geometrical protrusions of a uniform height on at least one of its sides, a top surface of each of the geometrical protrusions defining a flat surface, the geometrical protrusion being made of the ceramic or cemented carbide materials of the substrate; and a diamond layer of a uniformed thickness coating substantially the entirety of the surface of the substrate.

* * * * *